US009527299B2

(12) United States Patent
Nakata

(10) Patent No.: US 9,527,299 B2
(45) Date of Patent: Dec. 27, 2016

(54) LIQUID SUPPLY UNIT

(71) Applicant: Seiko Epson Corporation, Tokyo (JP)

(72) Inventor: Satoshi Nakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/836,291

(22) Filed: Aug. 26, 2015

(65) Prior Publication Data

US 2016/0059568 A1 Mar. 3, 2016

(30) Foreign Application Priority Data

Aug. 29, 2014 (JP) ..... 2014-175154
Jul. 1, 2015 (JP) ..... 2015-132430

(51) Int. Cl.
*B41J 2/175* (2006.01)

(52) U.S. Cl.
CPC ..... *B41J 2/1752* (2013.01); *B41J 2/1753* (2013.01); *B41J 2/17513* (2013.01); *B41J 2/17546* (2013.01); *B41J 2/17553* (2013.01)

(58) Field of Classification Search
CPC ... B41J 2/1752; B41J 2/17553; B41J 2/17523; B41J 2/17526; B41J 2/17503; B41J 2/1753; B41J 2/175
USPC ..... 347/50, 85, 86
See application file for complete search history.

(56) References Cited

U.S. PATENT DOCUMENTS 8,231,209 B2 * 7/2012 Koizumi ..... B41J 2/1752 347/85
8,297,738 B1 10/2012 Kodama et al.
2007/0052774 A1 3/2007 Simizu et al.
2013/0182053 A1 * 7/2013 Kodama ..... B41J 2/17523 347/86
2015/0077486 A1 3/2015 Kodama et al.

FOREIGN PATENT DOCUMENTS

JP 2007-230249 A 9/2007
JP 2013-141804 A 7/2013
JP 2013-163364 A 8/2013
JP 5218712 B1 8/2013

* cited by examiner

*Primary Examiner* — Jannelle M. Lebron

(57) ABSTRACT

A new engagement mechanism is provided that enables a liquid supply unit to be removed from an on-carriage holder and does not exist in known techniques. The liquid supply unit includes a first face, a second face opposed to the first face, a third face intersecting the first face and the second face, a fourth face intersecting the first face and the second face and opposed to the third face, a liquid supply portion, a first engaging portion projecting from the third face and capable of engaging with the on-carriage holder, and an operation portion exposed to the second face.

10 Claims, 16 Drawing Sheets

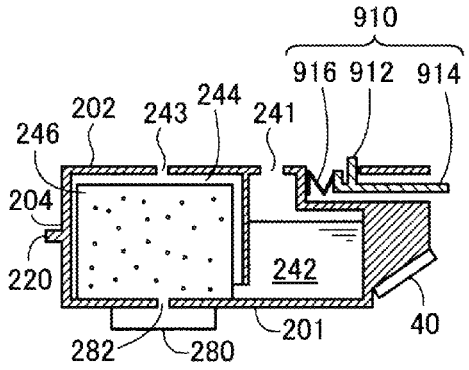
FIG.15A
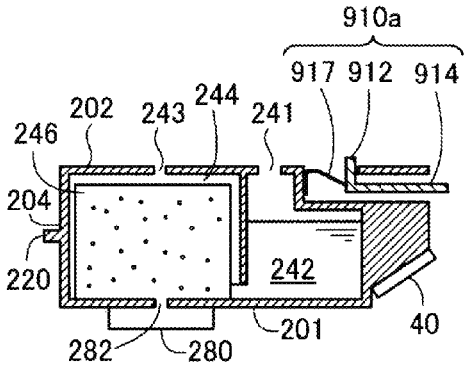
FIG.15B
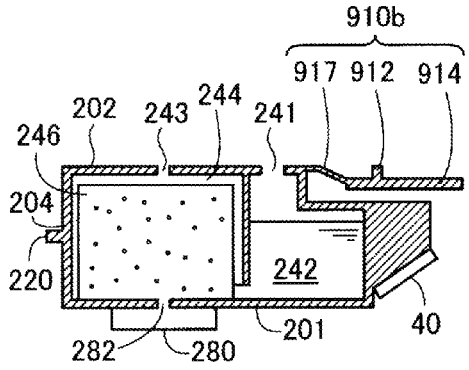
FIG.15C
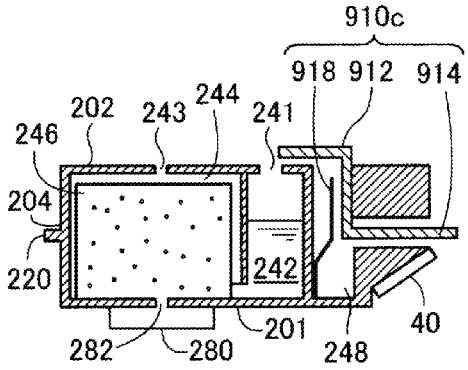
FIG.15D
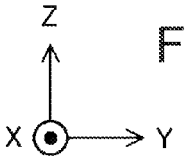

20c
204
202
203
220
40
208
205(206)
280
201

20d
204
202
203
220
40
208
205(206)
280
201

20e
204
202
203
220
40
208
205(206)
280
201

20f
204
202
203
220
40
208
205(206)
280
201

20g
204
202
203
220
208
40
205(206)
280
201

20h
204
202
203
220
208h
40
205(206)
280
201

LIQUID SUPPLY UNIT

BACKGROUND

1. Technical Field

The present invention relates to liquid supply units to be attached to carriage units of liquid ejection apparatuses.

2. Related Art

Printers have been widely used as a kind of liquid ejection apparatuses, and ink cartridges are used as liquid supply units for the printers. Hitherto, various engagement mechanisms for attaching and detaching the ink cartridges to/from the printers have been proposed. For example, a technique of providing a lever serving as the engagement mechanism on a side wall of an ink cartridge is known (JP-A-2007-230249). In this known technique, upon attaching the ink cartridge to a holder, the lever of the ink cartridge engages with an engaging portion of the holder and fixed. At the time of detachment, the engagement between the ink cartridge and the engaging portion is cancelled by a user pressing the lever, and the ink cartridge can be detached from the holder. A technique of providing a lever serving as an engagement mechanism in a holder on a carriage of a printer is also known (JP-A-2013-141804). In this known technique, upon attaching the ink cartridge to a holder, an engaging portion of the ink cartridge engages with the lever of the holder and fixed. At the time of detachment, the engagement between the ink cartridge and the lever is cancelled by a user pressing the lever, and the ink cartridge can be detached from the holder.

If the size of the lever is further reduced similarly to a reduction in size of ink cartridges, there is a possibility that the operability of the lever is lost. For this reason, there has been difficulty in providing a lever such as one described in JP-A-2007-230249 on a side wall of an ink cartridge in some cases. Meanwhile, even if a lever is provided in a holder on a carriage of a printer as in JP-A-2013-141804, there has been cases where a user feels difficulty in correctly recognizing the position at which the user presses the lever, or correctly pressing the lever, since the lever has been becoming smaller and smaller with the reduction in size of ink cartridges. For this reason, provision of a new engagement mechanism that does not exist in known techniques has been demanded. This problem is not limited to the ink cartridges for printers, but is also a problem shared by liquid supply systems for other kinds of liquid ejection apparatuses.

SUMMARY

The invention has been made in order to solve at least a part of the foregoing problem, and can be achieved as the following modes or application examples.

(1) According to a first mode of the invention, a liquid supply unit to be attached to an on-carriage holder of a liquid ejection apparatus is provided. This liquid supply unit includes: a first face; a second face opposed to the first face; a third face intersecting the first face and the second face; a fourth face intersecting the first face and the second face and opposed to the third face; a liquid supply portion; a first engaging portion projecting from the third face and capable of engaging with the on-carriage holder; and an operation portion exposed to the second face and capable of controlling a position of the first engaging portion.

According to the first mode, the engagement between the first engaging portion and the on-carriage holder can be cancelled by controlling the position of the first engaging portion using the operation portion exposed to the second face of the liquid supply unit. Accordingly, the liquid supply unit can be removed from the on-carriage holder by a new engagement mechanism that does not exist in known techniques.

In an embodiment, the liquid supply portion may be configured to project from the first face in the direction extending from the second face toward the first face, and to be biased in the direction extending from the first face toward the second face by the on-carriage holder in a state where the liquid supply unit is attached to the on-carriage holder. The first engaging portion may be configured to project from the third face in the direction extending from the fourth face toward the third face, and to be able to restrict the movement of the liquid supply unit in the direction extending from the first face toward the second face within the on-carriage holder in a state where the liquid supply unit is attached to the on-carriage holder. The operation portion may be configured to be exposed from the second face in the direction extending from the first face toward the second face, and to be able to control the position of the first engaging portion in the direction extending from the third face toward the fourth face. The operation portion may be configured to bias the first engaging portion in the direction extending from the fourth face toward the third face. However, these configurations can be omitted or modified.

(2) The above liquid supply unit may further include a biasing portion that biases the first engaging portion in the direction extending from the fourth face toward the third face.

With this configuration, since the first engaging portion is biased by the biasing portion, the engaging state between the first engaging portion and the on-carriage holder can be reliably maintained.

(3) The above liquid supply unit may further include a second engaging portion projecting from the fourth face in a direction extending from the third face toward the fourth face, the second engaging portion being able to restrict movement of the liquid supply unit in the direction extending from the first face toward the second face within the on-carriage holder in a state where the liquid supply unit is attached to the on-carriage holder.

With this configuration, the liquid supply unit can be more reliably engaged with the on-carriage holder by the two engaging portions that are the first engaging portion and the second engaging portion.

(4) The above liquid supply unit may further include an electric terminal portion arranged between the first face and the third face. The operation portion and the first engaging portion may be arranged at a position of the electric terminal portion as projected in the direction extending from the first face toward the second face.

With this configuration, since the first engaging portion is located near the electric terminal portion, the electrical contact of the electric terminal portion can be stabilized.

(5) The above liquid supply unit may further include an electric terminal portion arranged between the first face and the third face. The biasing portion may be located at a position in the direction extending from the third face toward the fourth face between the liquid supply portion and the electric terminal portion.

With this configuration, a sufficient size of the biasing portion can be secured that allows the biasing portion to undergo deformation and generate sufficient biasing force.

(6) In the above liquid supply unit, the operation portion may be provided on the second face.

With this configuration, the user can easily operate the operation portion.

(7) In the above liquid supply unit, the first engaging portion may be able to move in a sliding manner in the direction extending from the fourth face toward the third face.

With this configuration, the first engaging portion can be easily engaged with the on-carriage holder by moving the first engaging portion in a sliding manner.

(8) According to a second mode of the invention, a liquid supply unit to be attached to an on-carriage holder of a liquid ejection apparatus is provided. This liquid supply unit includes: a liquid containing chamber capable of containing liquid; a liquid supply portion coming into contact with the on-carriage holder and capable of supplying the liquid to the on-carriage holder; an electric terminal portion capable of being electrically connected to the on-carriage holder; a first engaging portion that is movable and capable of engaging with the on-carriage holder; a second engaging portion capable of engaging with the on-carriage holder; and an operation portion capable of controlling a position of the first engaging portion. In a state where the liquid supply unit is attached to the on-carriage holder, the liquid supply portion may be biased from the on-carriage holder in a first direction, the electric terminal portion may be biased from the on-carriage holder in the first direction, the first engaging portion may be able to restrict movement of the liquid supply unit from the on-carriage holder in the first direction, the second engaging portion may be able to restrict movement of the liquid supply unit from the on-carriage holder in the first direction, the liquid supply portion may be located at a position in a second direction that intersects the first direction between the first engaging portion and the second engaging portion, the electric terminal portion may be located at a position in the second direction between the liquid supply portion and an engaging point of the first engaging portion and the on-carriage holder, and the operation portion may be located at a position in the second direction between the first engaging portion and the second engaging portion.

According to the second mode, the engagement between the first engaging portion and the on-carriage holder can be cancelled using the operation portion provided in the liquid supply unit. Accordingly, the liquid supply unit can be removed from the on-carriage holder by a new engagement mechanism that does not exist in known techniques. Also, the liquid supply unit can be more reliably engaged with the on-carriage holder by the two engaging portions that are the first engaging portion and the second engaging portion. Furthermore, since the operation portion is located at a position in the second direction between the first engaging portion and the second engaging portion, the size of the operation portion can be secured with which the operation portion can be sufficiently easily operated. Furthermore, since the liquid supply portion is located between the first engaging portion and the second engaging portion, an engaging state can be achieved where the liquid supply portion can resist biasing force received from the on-carriage holder in a balanced manner with these two engaging portions.

(9) The above liquid supply unit may further include a biasing portion that biases the first engaging portion.

With this configuration, since the first engaging portion is biased by the biasing portion, the engaging state between the first engaging portion and the on-carriage holder can be reliably maintained.

(10) In the above liquid supply unit, the operation portion may be located in the liquid supply unit on the side in the first direction.

With this configuration, since the operation portion is located in the liquid supply unit on the side in the first direction, a structure that allows the user to easily operate the operation portion can be achieved.

(11) In the above liquid supply unit, the biasing portion may be located at a position in the second direction between the second engaging portion and the electric terminal portion.

With this configuration, a sufficient size of the biasing portion can be secured that allows the biasing portion to undergo deformation and generate sufficient biasing force.

(12) In the above liquid supply unit, the operation portion may be located at a position in the second direction between the first engaging portion and the second engaging portion.

With this configuration, since the operation portion is located between the first engaging portion and the second engaging portion, the operation portion can be operated in a state where the liquid supply unit is engaged with the on-carriage holder by the two engaging portions provided on both sides of the operation portion. Accordingly, the operation portion can be operated in a state where the posture of the liquid supply unit is stable.

(13) In the above liquid supply unit, the first engaging portion may be able to move in a sliding manner in the second direction.

With this configuration, the first engaging portion can be easily engaged with the on-carriage holder by moving the first engaging portion in a sliding manner.

(14) In the above liquid supply unit, the first engaging portion and the operation portion may be integrally molded with each other.

With this configuration, the operation portion and the first engaging portion can be achieved with a small number of parts.

(15) In the liquid supply unit, the biasing portion may be integrally molded with the first engaging portion and the operation portion.

With this configuration, the biasing portion, the operation portion, and the first engaging portion can be achieved with a small number of parts.

(16) In the liquid supply unit, the first engaging portion may be integrally molded with the second engaging portion, the operation portion, and the biasing portion.

With this configuration, the first engaging portion, the second engaging portion, the operation portion, and the biasing portion can be achieved with a small number of parts.

The invention can be achieved in various modes, and for example, the invention can be achieved not only as a liquid supply unit but also in various modes such as a liquid ejection apparatus including a liquid supply unit.

BRIEF DESCRIPTION OF THE DRAWINGS

The invention will be described with reference to the accompanying drawings, wherein like numbers reference like elements.

FIGS. 15A to 15D are illustrative views of ink cartridges in other embodiments.

DESCRIPTION OF EXEMPLARY EMBODIMENTS

A. First Embodiment

Figure 1:
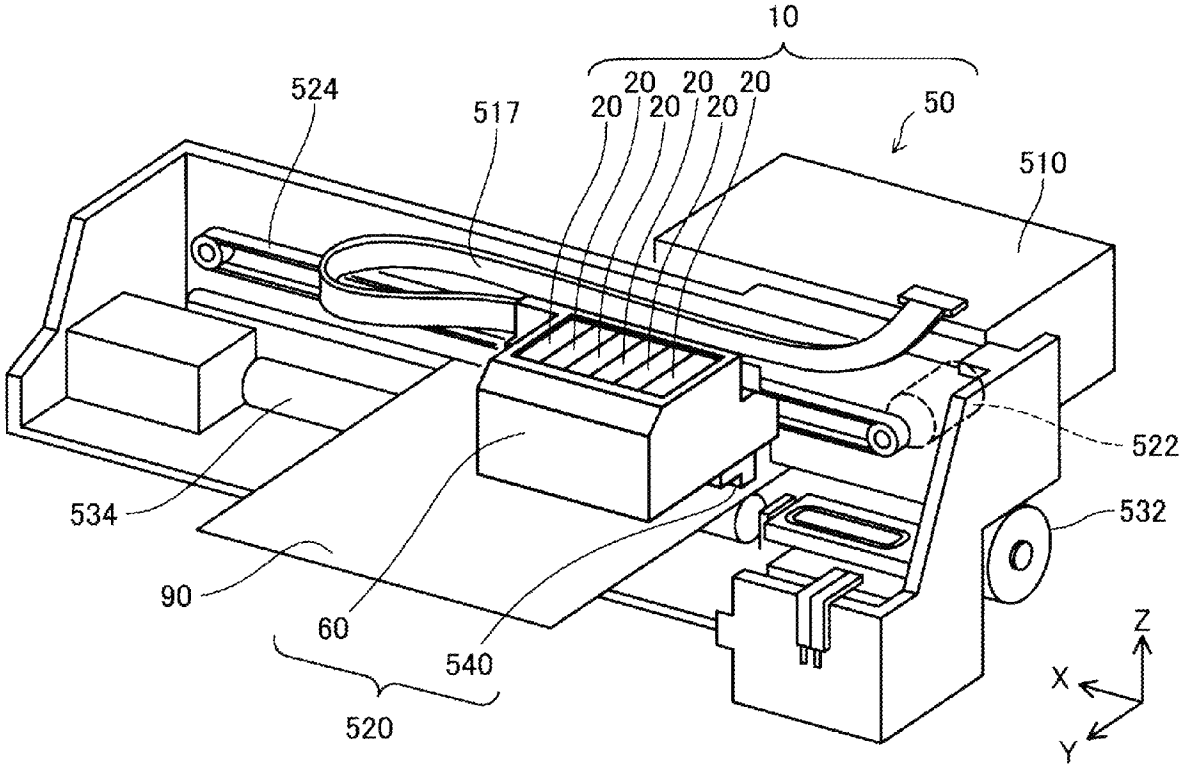
FIG. 1 is a perspective view of a liquid ejection system.

FIG. 1 is a perspective view of a liquid ejection system 10 in an embodiment of the invention. In FIG. 1, XYZ axes orthogonal to one another are indicated. The XYZ axes in FIG. 1 correspond to XYZ axes in the other diagrams. The XYZ axes are also given as necessary in the subsequent diagrams. The liquid ejection system 10 includes ink cartridges 20 each serving as a liquid supply unit, and a printer 50 serving as a liquid ejection apparatus.

The printer 50 includes a control unit 510 and a carriage unit 520. The carriage unit 520 includes a print head 540 and an on-carriage holder 60. The ink cartridges 20 are detachably attached to the on-carriage holder 60 by a user. Note that the ink cartridges 20 will also be called "cartridges". The on-carriage holder 60 will also be called a "holder", a "holder unit", or a "cartridge attaching portion".

The control unit 510 in the printer 50 controls each part of the printer 50. The carriage unit 520 is configured to be able to relatively move the print head 540 with respect to a print medium 90. The control unit 510 and the carriage unit 520 are electrically connected to each other via a flexible cable 517. The print head 540 operates based on a control signal from the control unit 510, and discharges ink to the print medium 90 such as paper or a label. Characters, diagrams, images, or the like are thereby printed on the print medium 90.

A printer such as the printer 50 in this embodiment in which the ink cartridges 20 are attached to the holder 60 of the carriage unit 520 is also called a printer of an "on-carriage type". In another embodiment, a configuration may be employed in which an unmovable stationary cartridge holder (off-carriage holder) is installed in a portion different from the position of the carriage unit 520, and ink is supplied from ink cartridges attached to this off-carriage holder to the print head 540 in the carriage unit 520 via a flexible tube. This type of printer is also called an "off-carriage type".

The printer 50 includes a main scan feeding mechanism and a sub-scan feeding mechanism for relatively moving the carriage unit 520 and the print medium 90. The main scan feeding mechanism includes a carriage motor 522 and a drive belt 524, for example, and moves the carriage unit 520 back and forth in a main scanning direction by transmitting power of the carriage motor 522 to the carriage unit 520 via the drive belt 524. The sub-scan feeding mechanism includes a conveyance motor 532 and a platen 534, for example, and conveys the print medium 90 in a sub-scanning direction that is orthogonal to the main scanning direction, by transmitting the power of the conveyance motor 532 to the platen 534. The carriage motor 522 in the main scan feeding mechanism and the conveyance motor 532 in the sub-scan feeding mechanism operate based on a control signal from the control unit 510.

In this specification, when the liquid ejection system 10 is in a state of being used (also referred to as a "posture of being used"), the axis along the main scanning direction (left-right direction) in which the carriage unit 520 is moved back and forth is assumed to be the X axis, the axis along the sub-scanning direction (front-rear direction) in which the print medium 90 is conveyed is assumed to be the Y axis, and the axis along the gravity direction (up-down direction) is assumed to be the Z axis. The state of the liquid ejection system 10 being used is the state of the liquid ejection system 10 installed on a horizontal plane, and the horizontal plane is a plane (XY plane) parallel with the Y axis and the X axis. Note that the sub-scanning direction (forward direction) is assumed to be a +Y direction, the direction (backward direction) opposite thereto is assumed to be a −Y direction, the direction (upward direction) extending upward from below in the gravity direction is assumed to be a +Z direction, and the direction (downward direction) opposite thereto is assumed to be a −Z direction. The side (front side) of the liquid ejection system 10 in the +Y direction is the front face of the liquid ejection system 10. The direction extending from the right side face toward the left side face of the liquid ejection system 10 is assumed to be a +X direction (leftward direction), and the direction opposite thereto is assumed to be a −X direction (rightward direction). The arranging direction of the plurality of cartridges 20 attached to the holder 60 is a direction parallel with the X axis. The +Z direction will also be called a "first direction", the +−Y direction will also be called a "second direction", and the −Z direction will also be called a "third direction".

The ink cartridges 20 contain ink serving as a print agent. The ink contained in the cartridges 20 is supplied to the print head 540 via a later-described ink supply port and ink supply tube. The plurality of cartridges 20 are detachably attached to the holder 60. In this embodiment, six types of cartridges 20 corresponding to six colors (black, yellow, magenta, light magenta, cyan, and light cyan) of ink are attached one by one, i.e., a total of six cartridges 20 are attached to the holder 60. However, the number of cartridges 20 that can be attached to the holder 60 and the ink type can be set in any manner. A detailed configuration of the cartridges 20 and the holder 60 will be described later.

Figure 2:
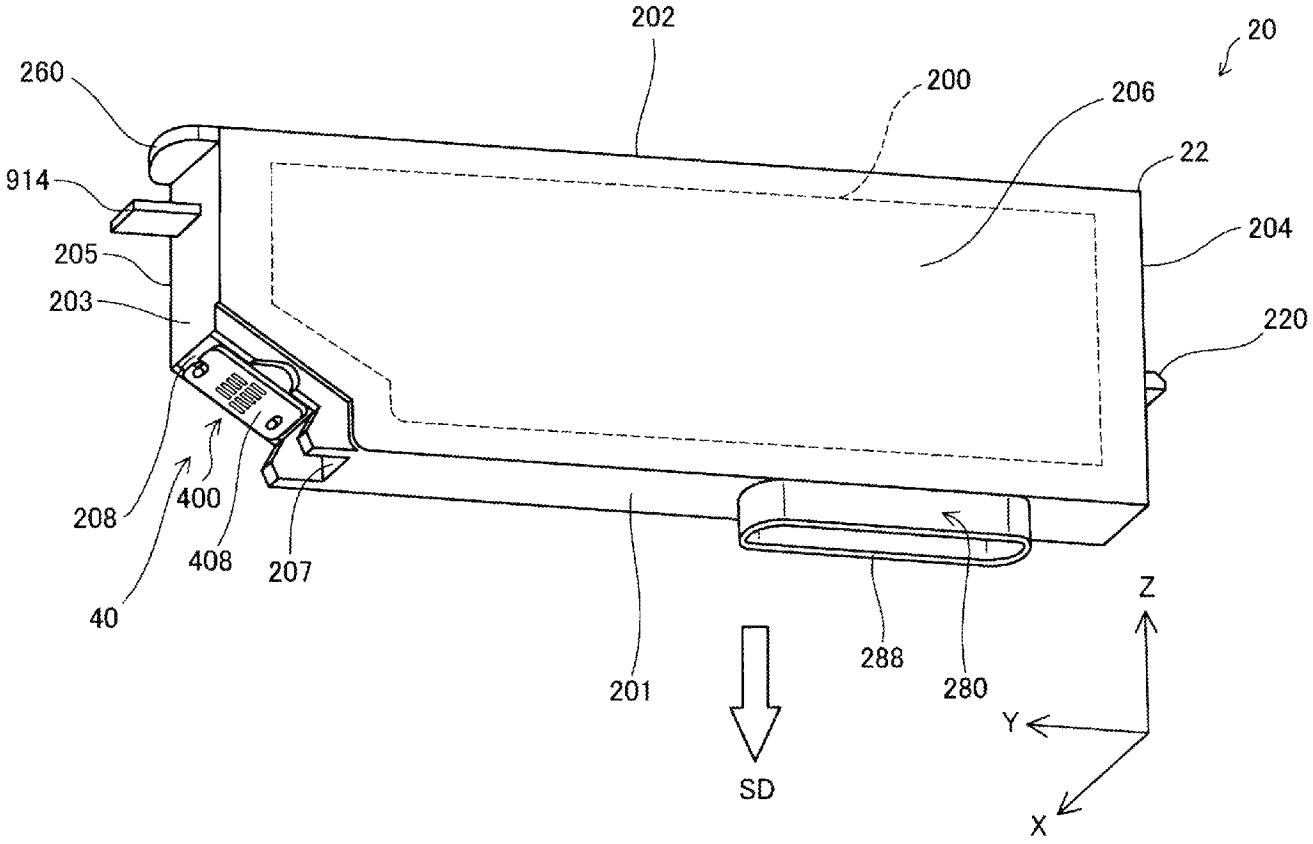
FIG. 2 is a perspective view of an ink cartridge in a first embodiment.
Figure 3:
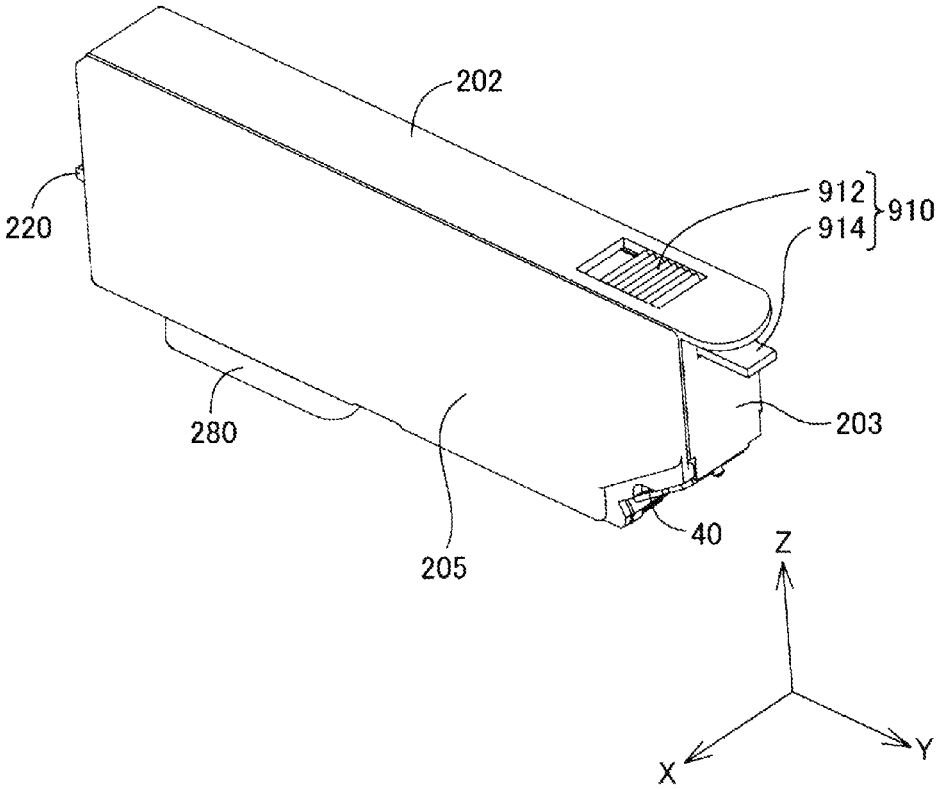
FIG. 3 is a perspective view of the ink cartridge in the first embodiment.

FIGS. 2 and 3 are perspective views of the ink cartridge 20. This cartridge 20 includes an outer shell 22, an ink supply port 280, a circuit board 40, an engagement structure 910 (FIG. 3) including an operation portion 912 and a first engaging portion 914, a second engaging portion 220, and a projecting portion 260. The first engaging portion 914 and the second engaging portion 220 are structures for engaging the cartridge 20 with the holder 60. The first engaging portion 914 has a movable configuration, and the second engaging portion 220 has an unmovable configuration. The second engaging portion 220 is integrally molded with the outer shell 22 of the cartridge 20. Meanwhile, the engagement structure 910 is formed as a body separate from the outer shell 22 of the cartridge 20. An attaching direction SD at the time of attaching the cartridge 20 to the holder 60 is the −Z direction. Note that the outer shell 22 will also be called a "cartridge body". The ink supply port 280 will also be called a "liquid supply portion".

The outer shell 22 demarcates and defines an inside space including an ink containing portion 200 (liquid containing chamber) of the cartridge 20. The outer shell 22 constitutes at least a part of the outer wall face of the cartridge 20. The outer shell 22 is formed by synthetic resin such as polypropylene (PP). The cartridge 20 has a substantially prism shape or a substantially rectangular parallelepiped shape. Note that a part of the outer shell 22 may be formed by a resin film.

The outer shell 22 has a first wall 201, a second wall 202, a third wall 203, a fourth wall 204, a fifth wall 205 (a wall on the side opposite to the sixth wall), a sixth wall 206, a seventh wall 207, and an eighth wall 208. In the following description, reference numerals 201 to 208 will also be used as numerals meaning outer surfaces (first to eighth faces 201 to 208) of walls constituting the outer shell 22 of the cartridge. Each of the first face 201 to the eighth face 208 is a substantially flat face. "Substantially flat face" encompasses the case where the entire face is completely flat and the case where a part of the face is uneven. That is to say, it encompasses the case where even if a part of the face is more or less uneven, the face and the wall constituting the outer shell of the cartridge 20 can be perceived. The outer shapes of all of the first face 201 to the eighth face 208 in a plan view are substantially rectangle.

The first face 201 is a face that serves as a bottom face in an attached state, and is a horizontal face. That is to say, the first face 201 is a face (XY plane) parallel with the Y axis and the X axis and vertical to the Z axis.

The second face 202 is a face that serves as an upper face in the attached state. The second face is opposed to the first face 201. The second face 202 is a face parallel with the first face 201. That is to say, the second face 202 is a face parallel with the Y axis and the X axis and vertical to the Z axis. The second face 202 is a horizontal face (XY plane) in the attached state.

The third face 203 is a face that serves as a front face in the attached state. The third face 203 is a face intersecting the first face 201 and the second face 202. The third face 203 is a face (XZ plane) parallel with the X axis and the Z axis and vertical to the Y axis. Note that in this specification, two faces "intersecting each other" means that the two faces are in one of a state of actually intersecting each other, a state where an extended face of one face intersects the other face, and a state where extended faces of the two faces intersect each other.

The fourth face 204 is a face that serves as a back face in the attached state. The fourth face 204 is a face intersecting the first face 201 and the second face 202. The fourth face 204 is a face parallel with the third face 203. The fourth face 204 is a face (XZ plain) parallel with the X axis and the Z axis and vertical to the Y axis.

The fifth face 205 is a face that serves as a left side face in the attached state, and the sixth face 206 is a face that serves as a right side face in the attached state. The fifth face 205 and the sixth face 206 are faces each intersecting the first to fourth faces 201 to 204. The fifth face 205 and the sixth face 206 are faces (YZ planes) parallel with the Y axis and the Z axis and vertical to the X axis. The sixth face 206 is a face parallel with the fifth face 205.

The seventh face 207 and the eighth face 208 are faces connecting the first face 201 and the third face 203. The seventh face 207 is a face intersecting the first face 201. The seventh face 207 is a face (XZ plain) parallel with the X axis and the Z axis. The seventh face 207, which serves as a step face, is a face erected with respect to the first face 201. That is to say, the seventh face 207 is a face extending from the first face 201 in the +Z direction. The seventh face 207 is located on the side in the −Y direction and the side in the −Z direction with respect to the eighth face 208. The eighth face 208 is a face connecting the seventh face 207 and the third face 203. The eighth face 208 is an inclined face that inclines while facing in a direction containing a +Y direction component and a −Z direction component. The eighth face 208 is a face that inclines with respect to the first face 201 and the third face 203. The eighth face 208 is a face intersecting the fifth face 205 and the sixth face 206. The eighth face 208 inclines with respect to an XY plane and an XZ plane, and intersects a YZ plane at a right angle. A normal vector of the eighth face 208 can be decomposed into a +Y direction component and a −Z direction component.

The circuit board 40 is installed on the eighth face 208. A normal vector of a surface 408 of the circuit board 40 can also be decomposed into a +Y direction component and a −Z direction component, similarly to the eighth face 208. The surface 408 is a face that inclines with respect to the first face 201 and the third face 203. The surface 408 is a face intersecting the fifth face 205 and the sixth face 206. The surface 408 inclines with respect to an XY plane and an XZ plane, and intersects a YZ plane at a right angle. The surface 408 can also be called an "inclined face 408". The surface 408 is provided with a cartridge-side electric terminal group 400. The back side of the circuit board 40 is provided with an electric device (not shown) such as a storage device. This electric device is connected to the cartridge-side electric terminal group 400 by interconnection. For example, information regarding ink in the cartridge 20 (the amount of remaining ink, ink color) or the like is stored in the storage device. The circuit board 40 will also be called an "electric terminal portion 40".

The ink supply port 280 is provided so as to project from the first face 201 toward the side in the −Z direction. The later-described ink supply tube of the printer 50 is connected to the ink supply port 280, which causes the ink in the cartridge 20 to flow to the print head 540. That is to say, the ink supply port 280 opens toward the outside, and causes the ink in the cartridge 20 to flow to the outside. The ink supply port 280 is provided in a portion of the first face 201 that is closer to the fourth face 204 than to the third face 203. That is to say, the distance in the Y direction between the outer surface of the ink supply port 280 and the third face 203 is larger than the distance in the Y direction between the outer surface of the ink supply port 280 and the fourth face 204.

The leading end of the ink supply port 280 opens. A face (opening face) 288 formed by this opening is a horizontal face in the attached state. That is to say, the opening face 288 is a face (XY plane) parallel with the Y axis and the X axis. When the cartridge 20 is shipped from the factory, the opening face 288 of the ink supply port 280 is sealed by a seal member (not shown) such as a cap or a film. The sealing member (not shown) for sealing the opening face 288 is removed from the cartridge 20 before attaching the cartridge 20 to the holder 60.

The first engaging portion 914 projects in the +Y direction from the third face 203 of the cartridge 20. This first engaging portion 914 is configured to be able to slide in the +−Y direction. In the first embodiment, upon the user moving the operation portion 912 in the −Y direction, the first engaging portion 914 accordingly slides in the −Y direction. As a result of the first engaging portion 914 engaging with a later-described apparatus-side first engaging portion within the holder 60 in a state where the cartridge 20 is attached to the holder 60, the first engaging portion 914 restricts movement of the cartridge 20 in the +Z direction. The details of the engagement structure 910 including the operation portion 912 and the first engaging portion 914 and operations thereof will be described later.

The cartridge 20 further has a second engaging portion 220 provided on the fourth face 204. The second engaging portion 220 is a projection provided so as to project from the fourth face 204 toward the side in the −Y direction. The second engaging portion 220 has a function of restricting movement of the cartridge 20 in the +Z direction, by engaging with a later-described apparatus-side second engaging portion within the holder 60 in a state where the cartridge 20 is attached to the holder 60.

Figure 4:
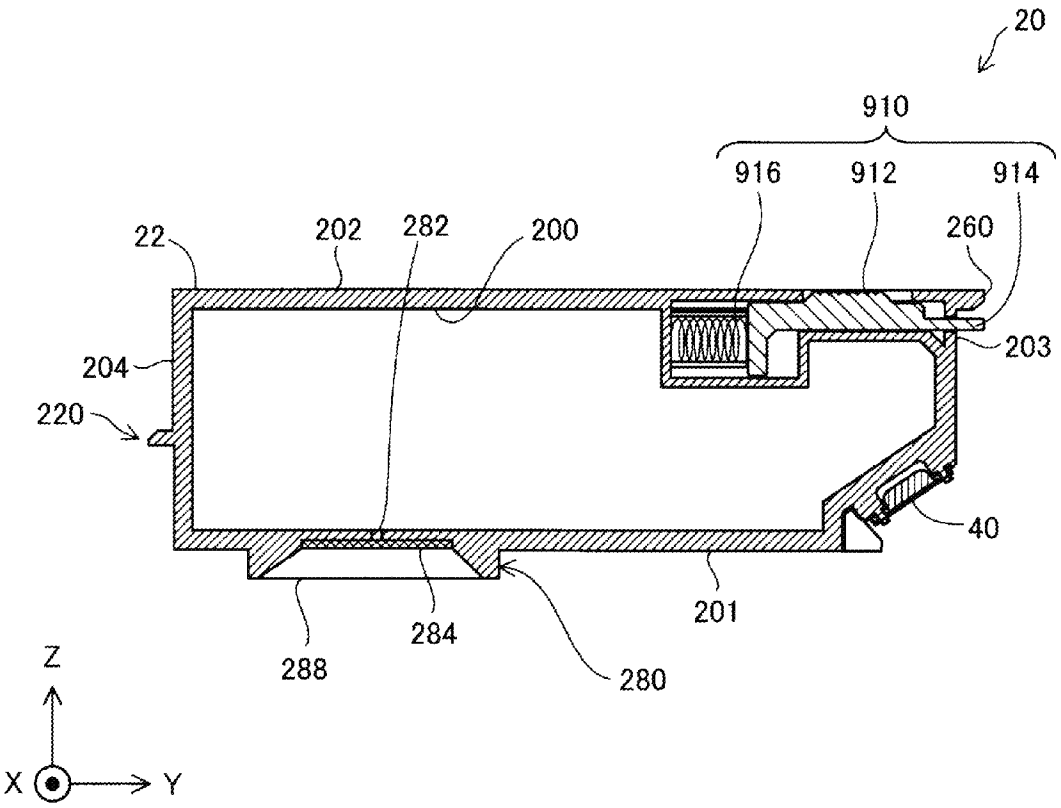
FIG. 4 is a cross-sectional view of a principal part of the ink cartridge in the first embodiment.

FIG. 4 is a cross-sectional view showing a principal part of the cartridge 20. The ink containing portion 200 of the cartridge 20 is in communication with the ink supply port 280 via an ink flow hole 282. Foam resin 284 is arranged at the ink supply port 280.

The engagement structure 910 has a biasing portion 916 as well as the operation portion 912 and the first engaging portion 914. The biasing portion 916 biases the operation portion 912 and the first engaging portion 914 in the +Y direction. In this example, the biasing portion 916 is a metallic spring. It is preferable that the biasing portion 916 is located at a position in the Y direction between the ink supply port 280 and the circuit board 40. With this configuration, a sufficient size of the biasing portion 916 can be secured that allows the biasing portion 916 to undergo deformation and generate sufficient biasing force. However, the biasing portion 916 may be omitted.

The first engaging portion 914 is a flat plate-shaped member extending in the Y direction, and is configured to be able to slide in the +−Y direction. In this example, the operation portion 912 and the first engaging portion 914 are integrally molded using the same material. Accordingly, it is possible to install the engagement structure 910 including the operation portion 912 and the first engaging portion 914 with a small number of parts. However, the operation portion 912 and the first engaging portion 914 may be formed as separate bodies and combined with the biasing portion 916 to constitute the engagement structure 910. Since the first engaging portion 914 is biased in the +Y direction by the biasing portion 916, the first engaging portion 914 is located at the most advanced position in the +Y direction in a movable area thereof when the cartridge 20 is in an unused state. Note that FIG. 4 shows a state after the operation portion 912 and the first engaging portion 914 move in the −Y direction. It is preferable that the operation portion 912 and the first engaging portion 914 are located at a position of the circuit board 40 as projected in the +Z direction. With this configuration, the first engaging portion 914 is located near the circuit board 40, and it is accordingly possible to stabilize electrical contact between the circuit board 40 and apparatus-side terminals of the holder 60.

The operation portion 912 is used when the user moves the first engaging portion 914 in the −Y direction. In this example, the operation portion 912 is a member having a large number of recesses and protrusions on the surface. The recesses and protrusions of the operation portion 912 are exposed from an opening portion provided in the second face 202 of the cartridge 20. Upon pressing a finger of the user against the operation portion 912 to move the operation portion 912 in the −Y direction, the first engaging portion 914 accordingly moves in the −Y direction. Since the operation portion 912 is provided in a state of being exposed to the second face 202 of the cartridge 20, the user can easily operate the operation portion 912. Furthermore, it is preferable that the operation portion 912 is located between the first engaging portion 914 and the second engaging portion 220. With this configuration, the operation portion 912 can be operated in a state where the cartridge 20 is engaged with the holder 60 by the two engaging portions 914 and 220 provided on both sides of the operation portion 912. Accordingly, it is possible to operate the operation portion 912 in a state where the posture of the cartridge 20 is stable.

Figure 5:
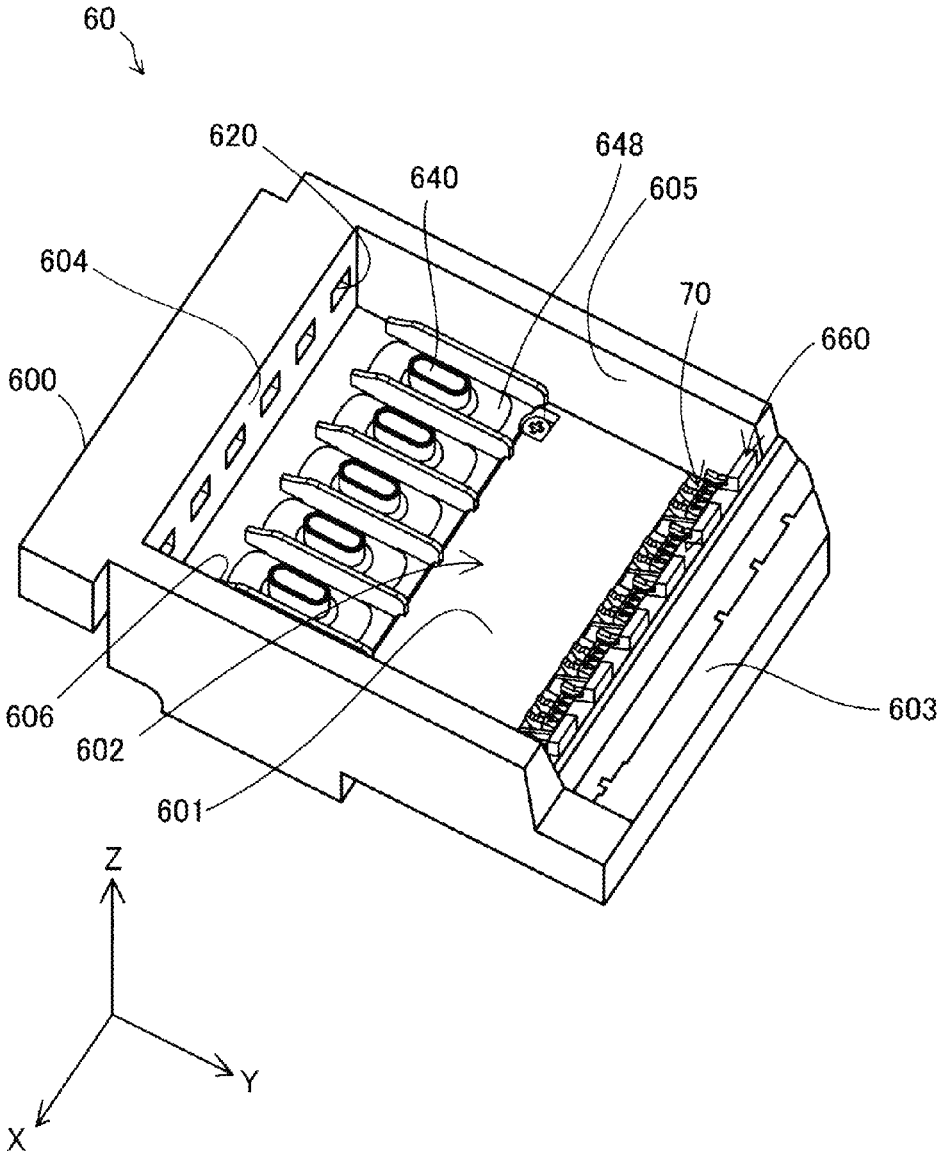
FIG. 5 is a perspective view of a cartridge holder.
Figure 6:
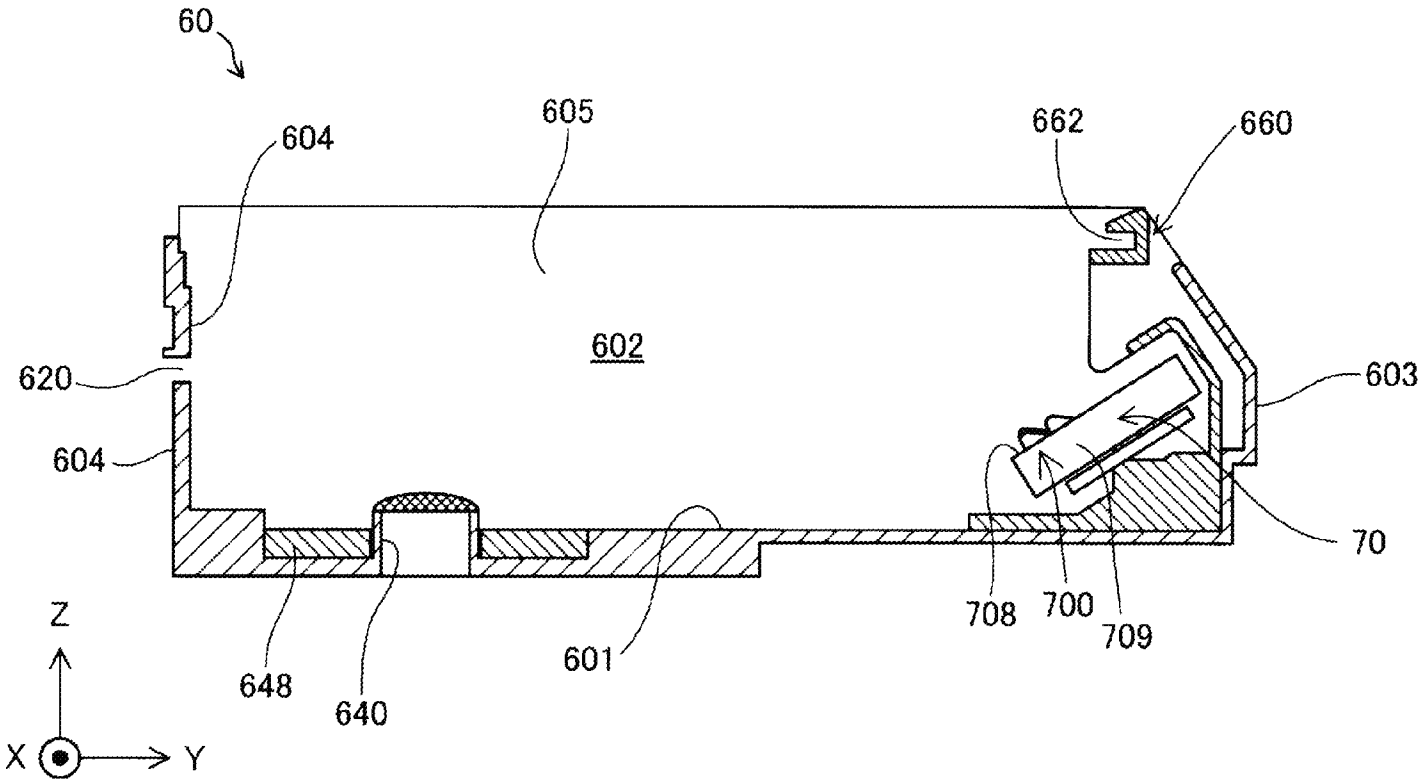
FIG. 6 is a cross-sectional view of a principal part of the cartridge holder.

FIG. 5 is a perspective view of the on-carriage holder 60, and FIG. 6 is a cross-sectional view of a principal part thereof. The holder 60 has five wall portions 601, 603, 604, 605, and 606 as wall faces defining a cartridge housing chamber 602 having a recess shape for receiving the cartridges 20. The five wall portions 601, 603, 604, 605, and 606 will be collectively called a "housing chamber forming wall portion 600". In this embodiment, the five wall portions 601, 603, 604, 605, and 606 are each formed by a synthetic resin plate-shaped member.

The wall portion 601 defines a bottom face of the cartridge housing chamber 602 having a recess shape. The wall portions 603, 604, 605, and 606 each define a side wall of the cartridge housing chamber 602 having a recess shape. The wall portion 601, the wall portion 603, the wall portion 604, the wall portion 605, and the wall portion 606 will also be called an "apparatus-side bottom wall portion 601", a "first apparatus-side side wall portion 603", a "second apparatus-side side wall portion 604", a "third apparatus-side side wall portion 605", and a "fourth apparatus-side side wall portion 606", respectively.

On the wall portion 601, ink supply tubes 640 and a contact point mechanism 70 including an apparatus-side terminal group are arranged in the Y direction. The ink supply tubes 640 are provided on the side closer to the wall portion 604 than to the wall portion 603. The contact point mechanism 70 is installed on the side closer to the wall portion 603 than the ink supply tubes 640 are.

An elastic member 648 is provided on the wall portion 601 around each ink supply tube 640. The elastic member 648 seals the periphery of the corresponding ink supply port 280 of the cartridge 20 in a state where the cartridge 20 is attached to the holder 60, and thereby prevents leakage of ink from the ink supply port 280 to the periphery thereof. The elastic member 648 generates biasing force in a direction (+Z direction) of pushing back the ink supply port 280 of the cartridge 20 in a state where the cartridge 20 is attached to the holder 60.

The wall portion 603 constitutes a front face of the holder 60. The wall portion 603 is provided with apparatus-side first engaging portions 660. Each apparatus-side first engaging portion 660 is a member that engages with the first engaging portion 914 of the corresponding cartridge 20. As shown in FIG. 6, it is preferable that the apparatus-side first engaging portions 660 are located at the position of the contact point mechanism 70 as projected in the +Z direction. Each apparatus-side first engaging portion 660 has an engaging recess portion 662 into which the first engaging portion 914 of the corresponding cartridge 20 is inserted. This engaging recess portion 662 corresponds to an engaging point of the first engaging portion 914 and the apparatus-side first engaging portion 660.

The wall portion 604 constitutes a back face of the holder 60. The wall portion 604 is provided with apparatus-side second engaging portions 620. Each apparatus-side second engaging portion 620 is a member that engages with the second engaging portion 220 of the corresponding cartridge 20. In this example, the apparatus-side second engaging portions 620 are through holes that penetrate the wall portion 604 in the Y direction. Note that each apparatus-side second engaging portion 620 may be a recess portion that is open while facing the cartridge housing chamber 602. The wall portion 605 constitutes a right side face of the holder 60. The wall portion 606 constitutes a left side face of the holder 60.

The contact point mechanism 70 is provided at a corner portion at which the wall portion 601 and the wall portion 603 of the holder 60 intersect each other. The contact point mechanism 70 is installed further on the side of the wall portion 603 than the ink supply tubes 640 are. As shown in FIG. 6, the contact point mechanism 70 has a plurality of apparatus-side electric terminals 700 that correspond to and come into contact with a plurality of electric terminals of the circuit board 40 (FIG. 2) of the cartridge 20, and a terminal base 709 that holds the plurality of apparatus-side electric terminals 700. The apparatus-side electric terminals 700 project from an inclined face 708 of the terminal base 709. The apparatus-side electric terminals 700 generate biasing force in a direction of pushing back the circuit board 40 of the cartridge 20 (i.e., a direction including a +Z direction component and a −Y direction component) in a state where the cartridge 20 is attached to the holder 60. The direction of this biasing force is a direction substantially vertical to the inclined face 708 of the terminal base 709. That is to say, upon the apparatus-side electric terminals 700 projecting from the inclined face 708 being pressed toward the side of the inclined face 708 by the cartridge 20, the apparatus-side electric terminals 700 apply, as counterforce, biasing force in an oblique direction to the cartridge 20.

Figure 7A:
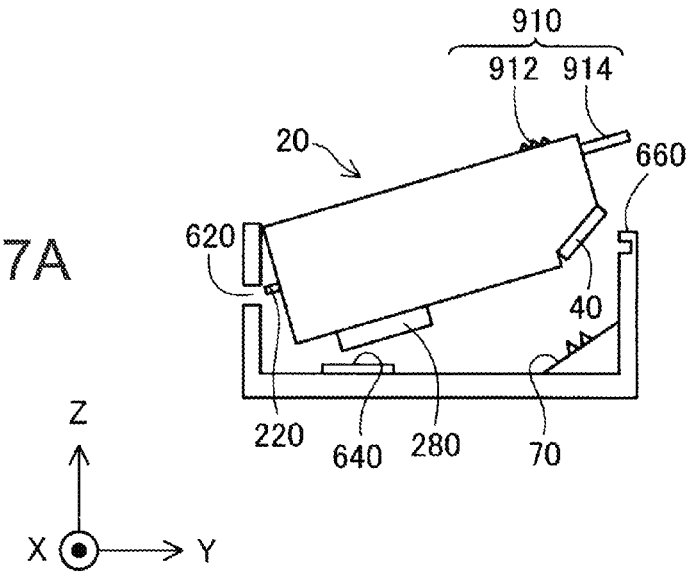
FIGS. 7A to 7C are illustrative views showing a state of attaching the cartridge to the holder.
Figure 7B:
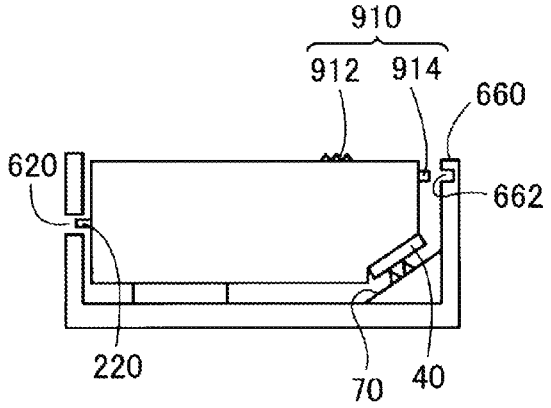
Figure 7C:
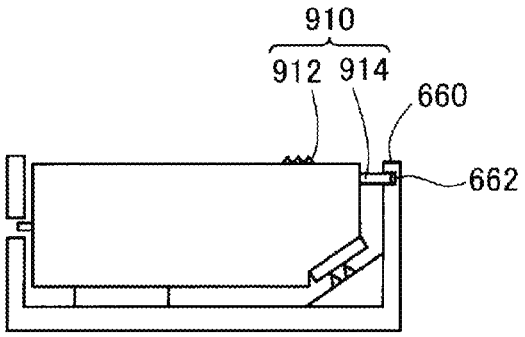

FIGS. 7A to 7C are illustrative views showing a state of attaching the cartridge 20 to the holder 60. Here, the outer shapes of the cartridge 20 and the holder 60 are simplified. When attaching the cartridge 20 into the holder 60, as shown in FIG. 7A, the cartridge 20 is caused to enter the inside of the holder 60 in an oblique posture with the rear end side (an end portion in the −Y direction) of the cartridge 20 slightly lowered. Then, the projection serving as the second engaging portion 220 formed on the fourth face 204 is inserted into the through hole serving as the apparatus-side second engaging portion 620 of the holder 60. The engagement between the second engaging portion 220 and the apparatus-side second engaging portion 620 restricts movement of the rear end side of the cartridge 20 in the +Z direction. Thereafter, a state in FIG. 7B is achieved upon the user operating the operation portion 912 to lower the front end side of the cartridge 20 in a state where the first engaging portion 914 is retracted in the −Y direction. Then, upon the user releasing the operation portion 912 (i.e., releasing a finger from the operation portion 912), the first engaging portion 914 is pushed back in the +Y direction by the biasing portion 916 (FIG. 4). As a result, as shown in FIG. 7C, the first engaging portion 914 enters the corresponding engaging recess portion 662 of the apparatus-side first engaging portion 660. In this state, movement of the cartridge 20 in the +Z direction is restricted by the two engaging portions that are the first engaging portion 914 and the second engaging portion 220.

Figures 8A, 8B, 8C:
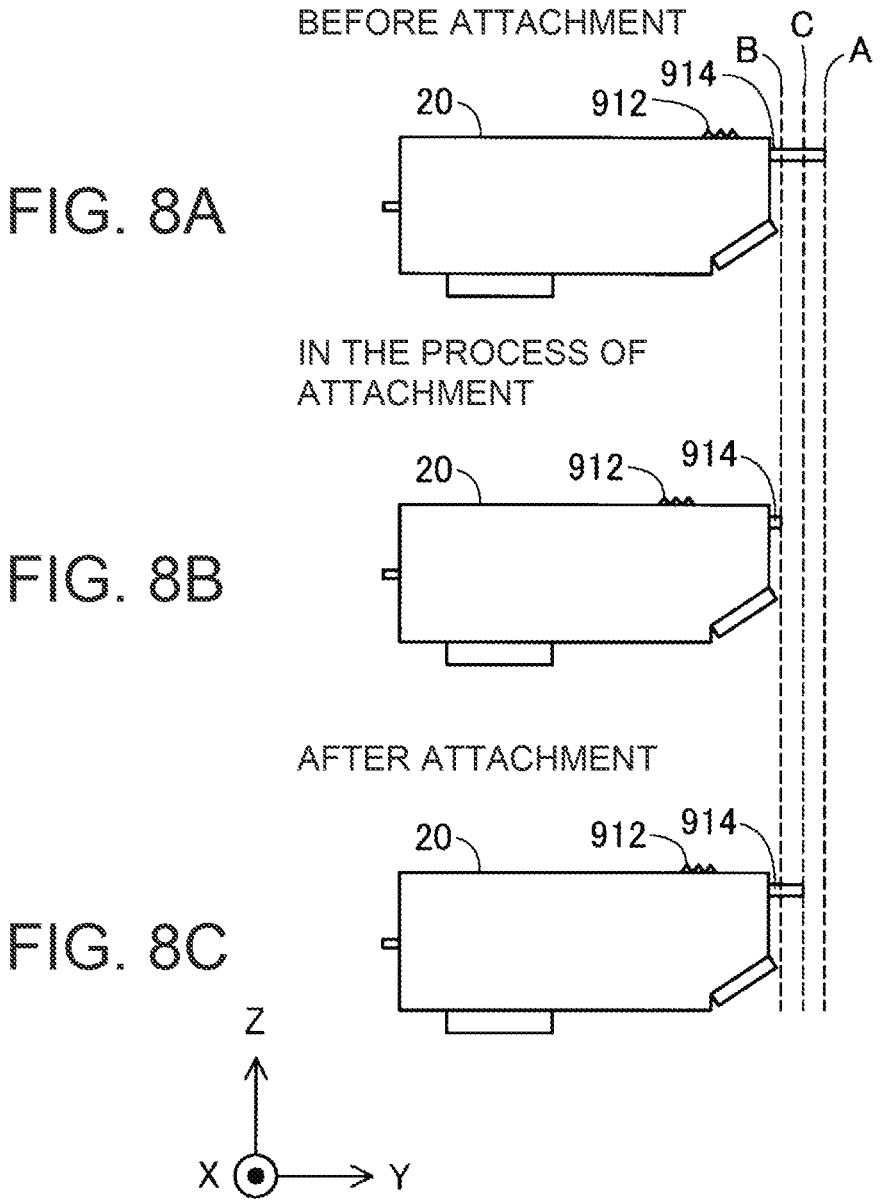
FIGS. 8A to 8C are illustrative views showing movement of a first engaging portion at the time of attaching the cartridge to the holder.

FIGS. 8A to 8C are illustrative views showing changes of the position of the first engaging portion 914 in FIG. 7 in the Y direction. In a state before attaching the cartridge 20 to the holder 60 (i.e., a state where the user is not touching the operation portion 912), the tip of the first engaging portion 914 is located at a first position A shown in FIG. 8A. The first position A is at the endmost portion on the side in the +Y direction in the movable area of the tip of the first engaging portion 914. In a state in the process of attachment shown in FIG. 7B, the tip of the first engaging portion 914 is located at a second position B shown in FIG. 8B. The second position B is a position moved back in the −Y direction relative to the first position A. In a state after attachment shown in FIG. 7C, the tip of the first engaging portion 914 is located at a third position C shown in FIG. 8C. The third position C is a position moved forward in the +Y direction relative to the second position B. Note that the third position C may be a position between the first position A and the second position B, or may be the same as the first position A. Thus, the first engaging portion 914 can be easily engaged with the apparatus-side first engaging portion 660 of the holder 60 by the user sliding the first engaging portion 914 in the +−Y direction using the operation portion 912.

Figure 9:
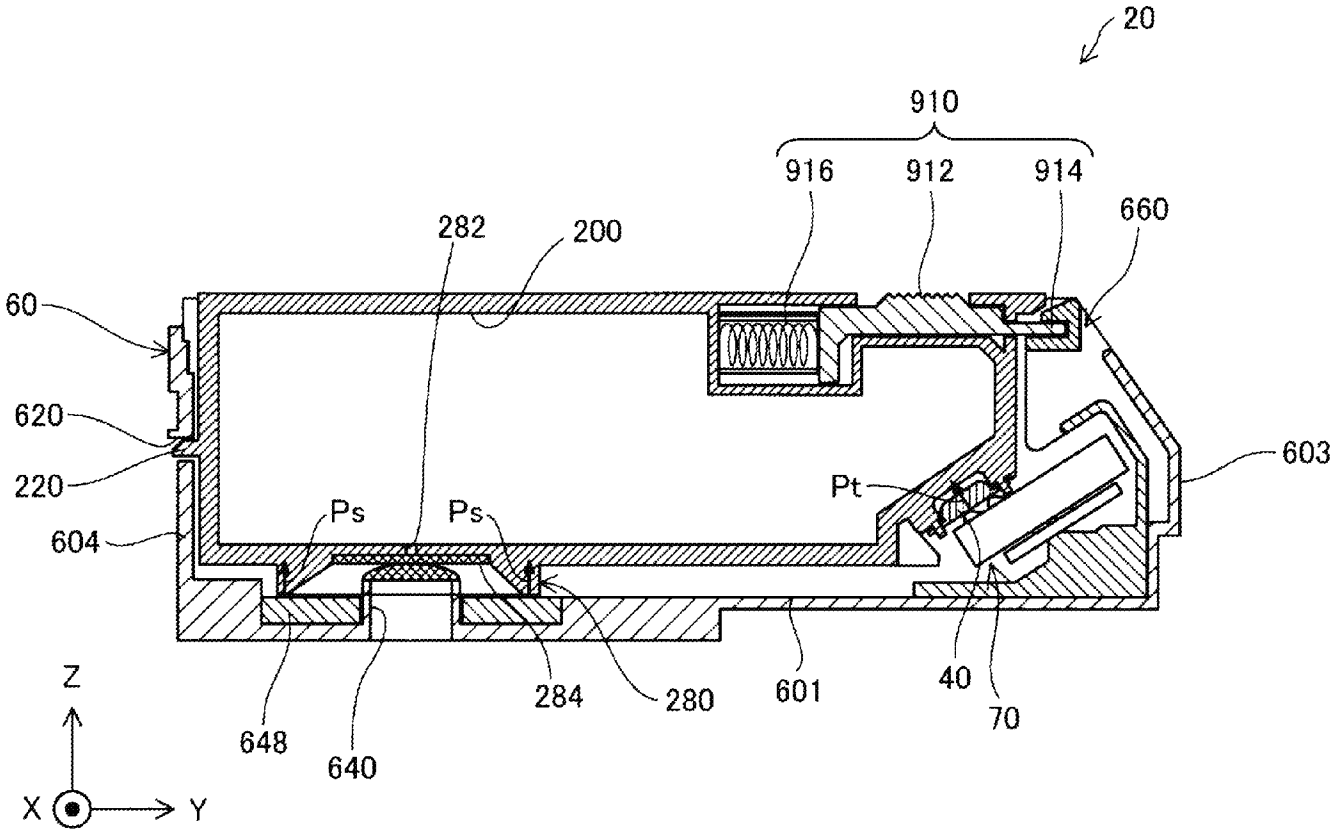
FIG. 9 is a cross-sectional view of a principal part showing a state where the cartridge is attached to the holder.

FIG. 9 is a cross-sectional view of a principal part showing a state where the cartridge 20 is attached to the holder 60. This diagram corresponds to the state shown in FIG. 7C. In the state where the cartridge 20 is attached into the holder 60, the ink supply port 280 of the cartridge 20 receives biasing force Ps in the +Z direction from the elastic member 648 at the periphery of the ink supply tube 640 of the holder 60. Also, the circuit board 40 of the cartridge 20 receives biasing force Pt in an oblique direction from the contact point mechanism 70. This biasing force Pt has a +Z direction component, and accordingly acts as force that biases the cartridge 20 in the +Z direction ("first direction") together with the biasing force Ps received by the ink supply port 280. The first engaging portion 914 and the second engaging portion 220 of the cartridge 20 have a function of fixing the cartridge 20 within the holder 60 in a stable state against the biasing forces Ps and Pt. Here, the "stable state" means that the ink supply port 280 and the ink supply tube 640 are in communication with each other without leakage, and electrical connection between the circuit board 40 and the contact point mechanism 70 is stable. Note that the circuit board 40 is located between the ink supply port 280 and the engaging point (engaging recess portion 662) of the first engaging portion 914 and the holder 60. Accordingly, the first engaging portion 914 is closer to the circuit board 40 than to the ink supply port 280, and therefore has a function of stabilizing the electrical connection between the circuit board 40 and the contact point mechanism 70.

As described above, in the first embodiment, the first engaging portion 914 capable of restricting upward movement of the cartridge 20 (in the +Z direction) from the holder 60 is provided on the third face 203 that is the front face of the cartridge 20. Therefore, the cartridge 20 can be engaged with the holder 60 using a structure that is different from known structures. Also, since the operation portion 912 capable of cancelling the engagement between the first engaging portion 914 and the holder 60 is provided in the cartridge 20, the cartridge 20 can be removed from the holder 60 using a new engagement mechanism that does not exist in known techniques.

B. Second Embodiment

Figure 10A:
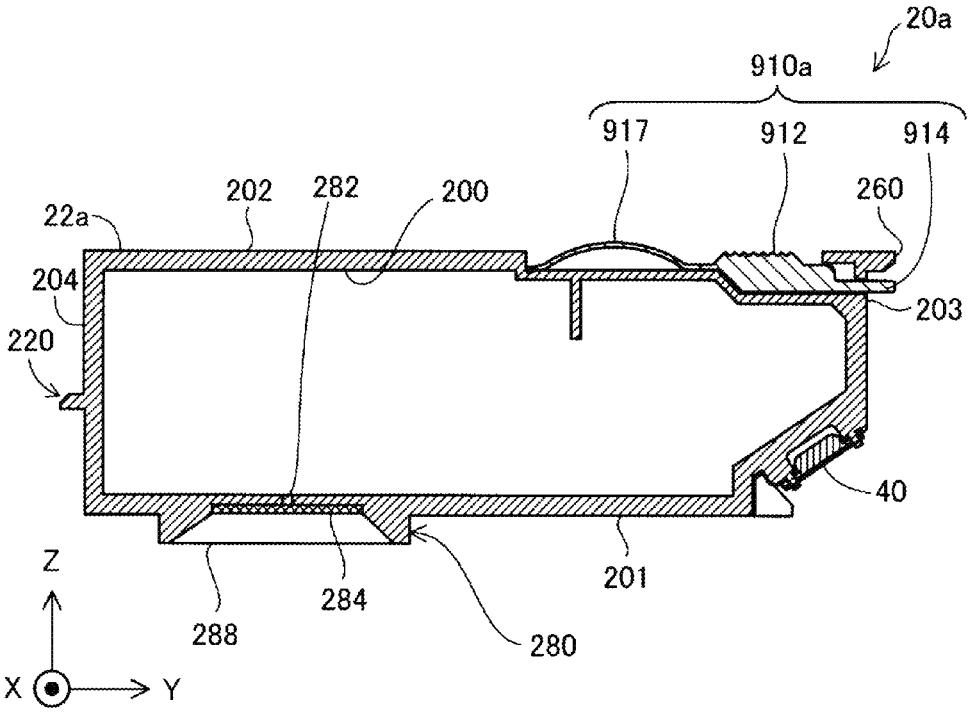
FIGS. 10A and 10B are cross-sectional views of a principal part of an ink cartridge in a second embodiment.

FIG. 10A is a cross-sectional view of a principal part of a cartridge 20*a* in a second embodiment, and is a diagram corresponding to FIG. 4 in the first embodiment. A difference from the first embodiment lies in that the configuration of an engagement structure 910*a* including the first engaging portion 914 and the operation portion 912 is different. The other structure of the cartridge 20*a* is roughly the same as that in the first embodiment shown in FIG. 2, and accordingly a description thereof will be omitted.

Figure 10B:
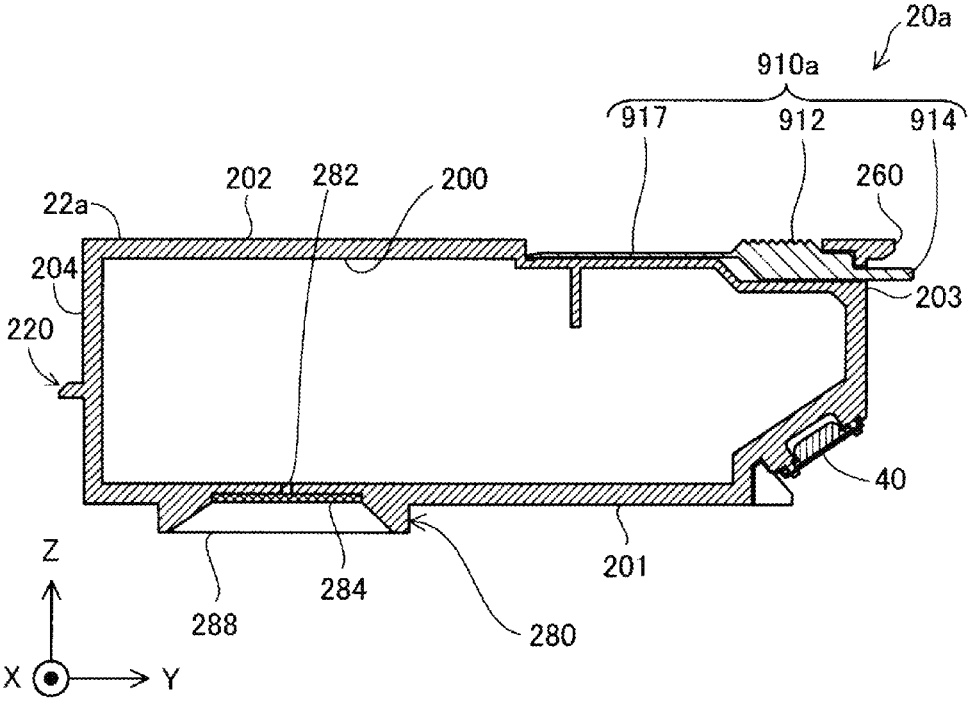

This engagement structure 910*a* has the first engaging portion 914 capable of moving in a sliding manner in the +−Y direction, the operation portion 912 to be operated by the user, and the biasing portion 917. In this example, the first engaging portion 914, the operation portion 912, and the biasing portion 917 are integrally molded with one another. The engagement structure 910*a* is formed as a body separate from an outer shell 22*a* of the cartridge 20*a*. FIG. 10A shows a state where the user has moved the operation portion 912 in the −Y direction, and FIG. 10B shows a state where the user has released the operation portion 912. The biasing portion 917 of the engagement structure 910*a* biases the first engaging portion 914 and the operation portion 912 in the +Y direction. In order to generate this biasing force, it is preferable that the engagement structure 910*a* is formed by elastic resin or the like. This second embodiment also achieves effects similar to those of the above-described first embodiment. Furthermore, in the second embodiment, since the first engaging portion 914, the operation portion 912, and the biasing portion 917 are integrally molded with one another, the number of parts can be further reduced than in the first embodiment.

C. Third Embodiment

Figure 11A:
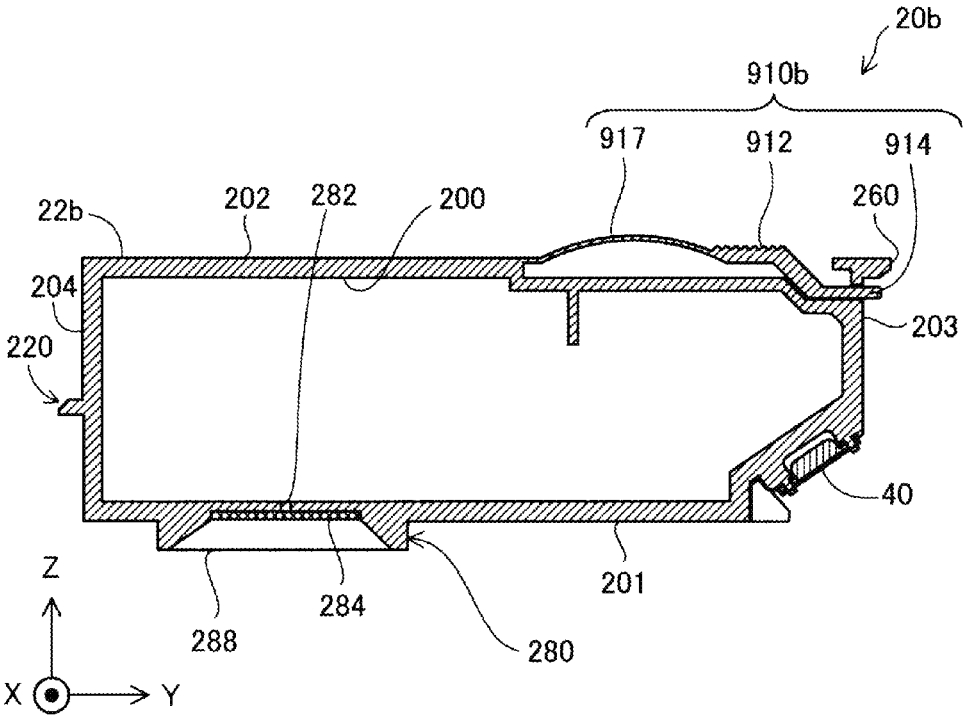
FIGS. 11A and 11B are cross-sectional views of a principal part of an ink cartridge in a third embodiment.
Figure 11B:
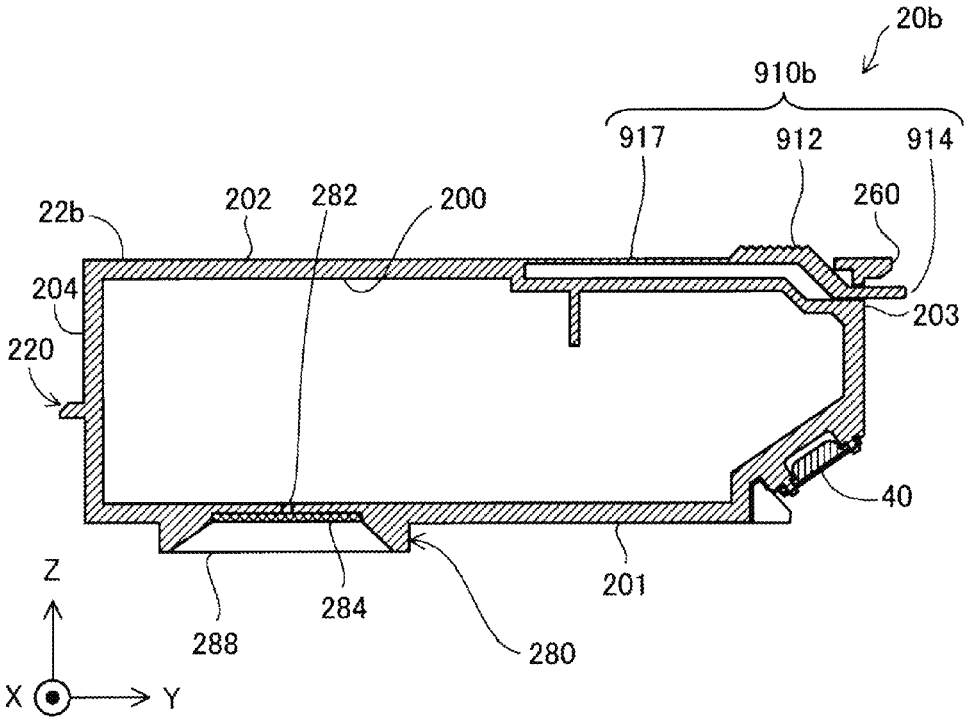

FIGS. 11A and 11B are cross-sectional views of a principal part of a cartridge 20*b* in a third embodiment, and is a diagram corresponding to FIGS. 10A and 10B in the second embodiment. A difference from the second embodiment lies in that an engagement structure 910*b* including the first engaging portion 914, the operation portion 912, and the biasing portion 917 are integrally molded with an outer shell 22*b* of the cartridge 20*b*. The other structure of the cartridge 20*b* is roughly the same as that in the first embodiment shown in FIG. 2, and accordingly a description thereof will be omitted.

This third embodiment also achieves effects similar to those of the above-described first and second embodiments. Furthermore, in the third embodiment, since the first engaging portion 914, the operation portion 912, and the biasing portion 917 are integrally molded with the outer shell 22*b* of the cartridge 20*b*, the number of parts can be further reduced than in the second embodiment.

D. Fourth Embodiment

Figure 12:
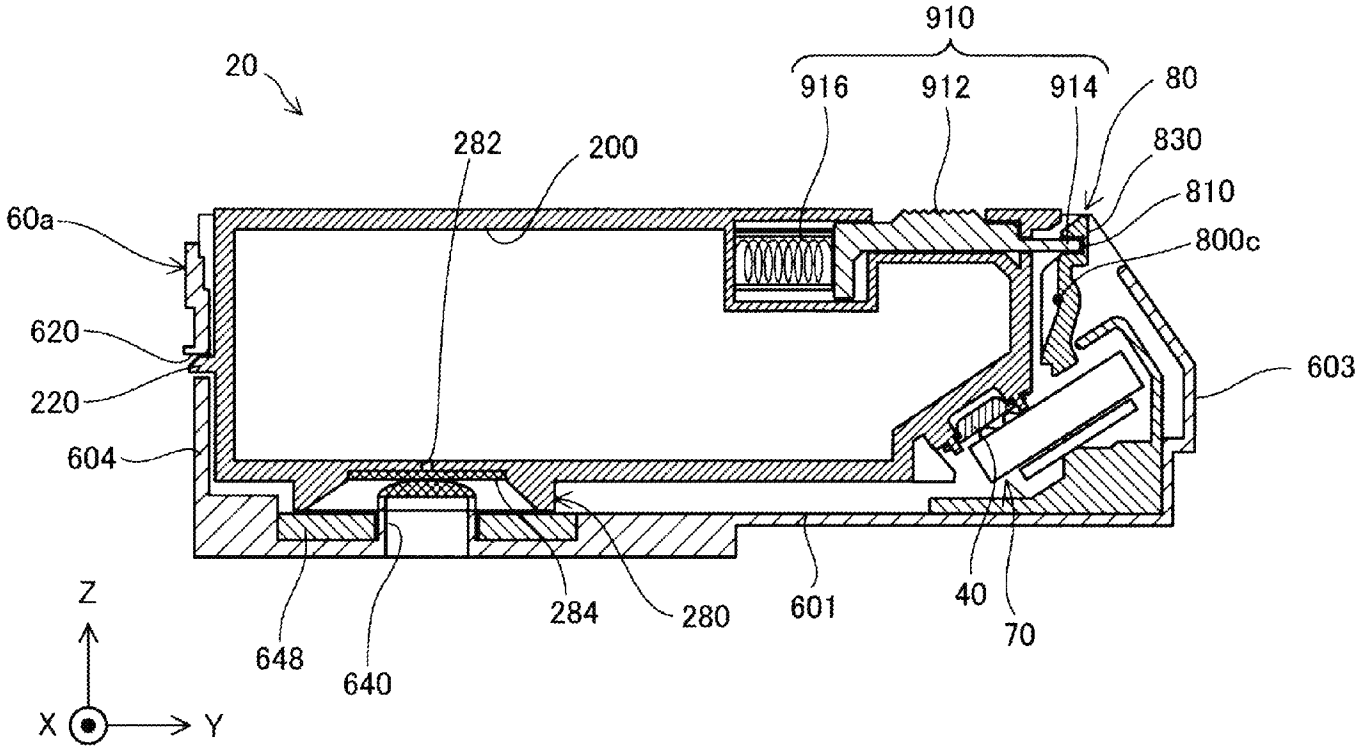
FIG. 12 is a cross-sectional view of a principal part showing a state where a cartridge is attached to a holder in a fourth embodiment.

FIG. 12 is a cross-sectional view of a principal part showing a state where the cartridge 20 is attached to a holder 60*a* in a fourth embodiment, and is a diagram corresponding to FIG. 9 in the first embodiment. A difference from the first embodiment lies in the configuration of an apparatus-side first engaging portion 80 of the holder 60*a*. The configuration of the other part of the holder 60*a* is roughly the same as that in the first embodiment, and the configuration of the cartridge 20 is the same as that in the first embodiment. Accordingly, a description thereof will be omitted.

The apparatus-side first engaging portion 80 is formed as a lever provided near the third wall 603 of the holder 60*a*. A recess portion 810 is formed on the inside (the side in the −Y direction) of a head portion of the apparatus-side first engaging portion 80. The first engaging portion 914 of the cartridge 20 can enter this recess portion 810. The apparatus-side first engaging portion 80 is installed so as to be able to rotate around a rotation axis 800*c*. That is to say, upon the user pressing, in the −Y direction, an outer face 830 (the face on the side in the +Y direction) of the head portion of the apparatus-side first engaging portion 80, the apparatus-side first engaging portion 80 rotates counterclockwise around the axis 800*c*. FIG. 12 shows a state where the outer face 830 of the apparatus-side first engaging portion 80 is not pressed. In this state, even if the apparatus-side first engaging portion 80 is pressed in the +Y direction by the first engaging portion 914, the apparatus-side first engaging portion 80 does not rotate and is maintained in the same posture. Accordingly, this apparatus-side first engaging portion 80 can also exert a function of engaging with the first engaging portion 914 of the cartridge 20 substantially similarly to the apparatus-side first engaging portion 660 in the first embodiment shown in FIGS. 6 and 9. This holder 60*a* can be used together with the cartridges in the above-described second and third embodiments. This fourth embodiment also achieves effects similar to those of the above-described first to third embodiments.

E. Fifth Embodiment

Figure 13:
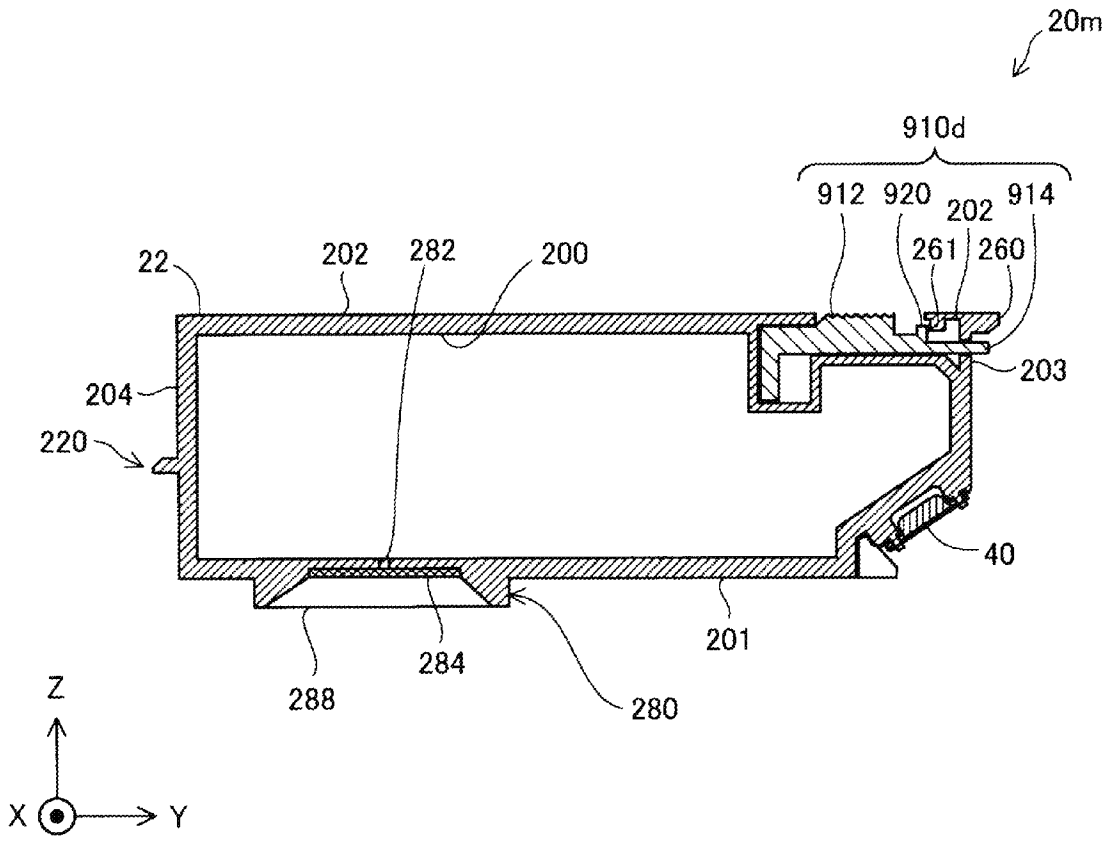
FIG. 13 is a cross-sectional view of a principal part of an ink cartridge in a fifth embodiment.

FIG. 13 is a cross-sectional view of a principal part of a cartridge 20*m* in a fifth embodiment, and is a diagram corresponding to FIG. 4 in the first embodiment. A difference from the first embodiment lies in that the configuration of an engagement structure 910*d* is different. The other structure of the cartridge 20*m* is roughly the same as that in the first embodiment shown in FIG. 2, and accordingly a description thereof will be omitted.

This engagement structure 910*d* does not include the biasing portion 916, and has a first engaging projection 920 that projects in the +Z direction toward the second wall 202, as well as the operation portion 912 and the first engaging portion 914. The second wall 202 has a second engaging projection 261 that projects in the −Z direction toward the engagement structure 910*d*. When the user operates the operation portion 912 and moves the first engaging portion 914 in the +Y direction, the first engaging projection 920 comes into contact with the second engaging projection 261. The engagement structure 910*d* or the second wall 202 temporarily undergoes elastic deformation, and the first engaging projection 920 thereby moves to a space between the second engaging projection 261 and the third wall 203. As a result, the cartridge 20*m* is engaged with the holder 60.

Figure 14:
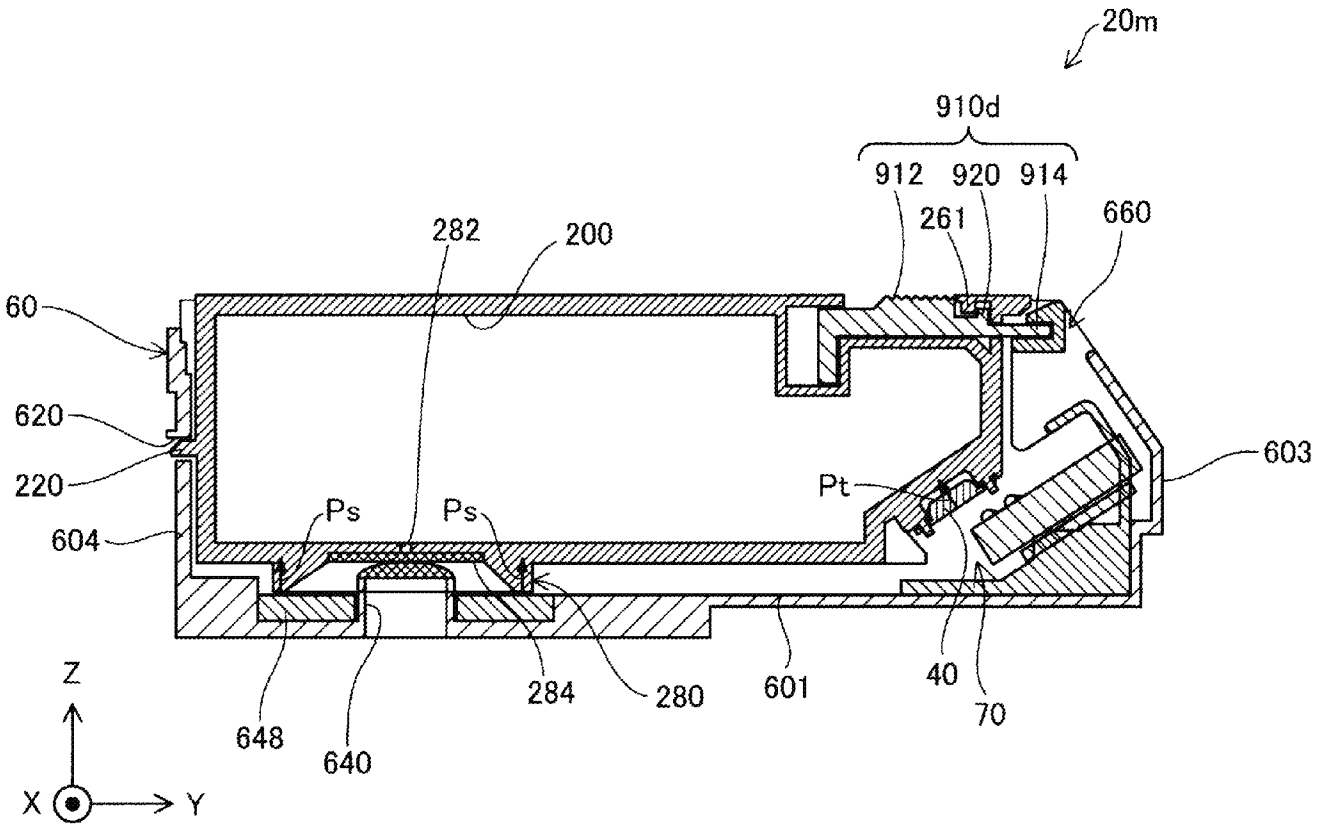
FIG. 14 is a cross-sectional view of a principal part showing a state where the cartridge is attached to a holder in the fifth embodiment.

FIG. 14 is a cross-sectional view of a principal part showing a state where the cartridge 20*m* is attached to the holder 60 in the fifth embodiment, and is a diagram corresponding to FIG. 9 in the first embodiment. In this attached state, the engagement structure 910*d* is fixed to the outer shell 22 of the cartridge 20*m* in a state where the first engaging projection 920 and the second engaging projection 261 engage with each other. Movement of the engagement structure 910*d* in the −Y direction is thereby restricted, and the engaging state is maintained between the apparatus-side first engaging portion 660 and the first engaging portion 914 that has projected from the third wall 203 in the +Y direction. As can be understood from the fifth embodiment, the engagement structure 910 may not have a biasing member. However, if the engagement structure 910 is configured to have a biasing member for biasing the first engaging portion 914, there is an advantage that reliable maintenance of the engaging state between the first engaging portion 914 and the holder 60 is facilitated.

F. Other Embodiments of Cartridge

FIGS. 15A to 15D are illustrative views showing configurations of the cartridge in other embodiments. Note that, in FIGS. 15A to 15D, the shape of each member is simplified for the sake of convenience of description.

A cartridge shown in FIG. 15A has an engagement structure 910 that is similar to that of the cartridge 20 in the first embodiment shown in FIG. 4. That is to say, this engagement structure 910 includes the first engaging portion 914, the operation portion 912, and the biasing portion 916. The first engaging portion 914 and the operation portion 912 are integrally formed, and the biasing portion 916 is formed by a separate spring. Note that in the cartridge in FIG. 15A, the structure for containing ink is different from that in FIG. 4. That is to say, an ink storage chamber 242 and an ink supply chamber 244 are demarcated between the fourth face 204 of the cartridge and the circuit board 40. The ink storage chamber 242 and the ink supply chamber 244 will also be collectively called a "liquid containing chamber". An ink injection port 241 is formed at a position on the second face 202 of the cartridge above the ink storage chamber 242. However, this ink injection port 241 is sealed with a sealing material or the like when the cartridge 20 is used. An atmosphere hole 243 is formed at a position on the second face 202 above the ink supply chamber 244. A porous ink holding member 246 is housed within the ink supply chamber 244. The ink supply chamber 244 is in communication with the ink supply port 280 via an ink flow hole 282.

A cartridge shown in FIG. 15B has a liquid containing chamber (the ink storage chamber 242 and the ink supply chamber 244) having the same structure as that shown in FIG. 15A, and has the engagement structure 910*a* that is similar to that of the cartridge 20*a* in the second embodiment shown in FIGS. 10A and 10B. That is to say, the first engaging portion 914, the operation portion 912, and the biasing portion 917 in this engagement structure 910*a* are integrally molded with one another. The engagement structure 910*a* is formed as a body separate from the outer shell of the cartridge.

A cartridge shown in FIG. 15C has a liquid containing chamber (the ink storage chamber 242 and the ink supply chamber 244) having the same structure as that shown in FIG. 15A, and has the engagement structure 910*b* that is similar to that of the cartridge 20*b* in the third embodiment shown in FIGS. 11A and 11B. That is to say, the first engaging portion 914, the operation portion 912, and the biasing portion 917 in this engagement structure 910*b* are integrally molded with the outer shell of the cartridge.

A cartridge shown in FIG. 15D has a liquid containing chamber (the ink storage chamber 242 and the ink supply chamber 244) having the same structure as that shown in FIG. 15A, but the engagement structure 910*c* is slightly different from that in the other embodiments. That is to say, the first engaging portion 914 and the operation portion 912 in this engagement structure 910*c* are integrally molded with each other. The biasing portion 918 is formed by a flat spring as a separate body. The biasing portion 918 is housed in a housing chamber 248 provided adjacent to the liquid containing chamber (more accurately, the ink supply chamber 244). This engagement structure 910*c* is similar to the engagement structure 910 shown in FIG. 15A, but is different in that the position of the first engaging portion 914 in the Z direction is further on the side in the −Z direction than that in FIG. 15A, and is in an area lower than or equal to one-half of the height of the cartridge. Note that the "height of the cartridge" means the largest distance between the first face 201 and the second face 202 in the Z direction. In this engagement structure 910*c*, the position of the first engaging portion 914 in the Z direction is lower than that in FIG. 15A. Accordingly, the state of connection to the circuit board 40 can be further stabilized.

As can be understood from FIGS. 15A to 15D, the configuration of the liquid containing chamber and the engagement structure 910 of the cartridge can be modified in various manners. In the modifications thereof as well, effects that are roughly similar to those of the above-described first to fourth embodiments can be achieved.

Note that, as can be understood from the modifications in FIGS. 15A to 15D, the operation portion 912 does not need to be provided on the second face 202 of the cartridge. However, it is preferable that the operation portion 912 is at least exposed to the second face 202. Here, the expression that "the operation portion 912 is exposed to the second face 202" is used to mean the case (i) where the operation portion 912 is provided on the second face 202, and the case (ii) where the operation portion 912 is not provided on the second face 202, but a part of the operation portion 912 is exposed to the second face 202.

FIGS. 16A to 16F are conceptual diagrams showing shapes of the cartridge in other embodiments. Note that FIGS. 16A to 16F omit the engagement structure 910 for the sake of convenience of the drawings. An outer shell 22*c* of a cartridge 20*c* shown in FIG. 16A has an ellipse or oblong side wall. The cartridge 20*c* has the circuit board 40 on the front face side. The ink supply port 280 is formed on the bottom face side of the cartridge 20*c*, and the second engaging portion 220 is formed on the back face side. Note that this cartridge 20*c* has a fixed width as viewed from the front face side. This cartridge 20*c* can also be compatible with the cartridges 20 and 20*a* in the above-described embodiments if the circuit board 40 and the ink supply port 280 are configured to be connected to corresponding members of the printer 50.

Figures 16A, 16B, 16C, 16D, 16E, 16F:
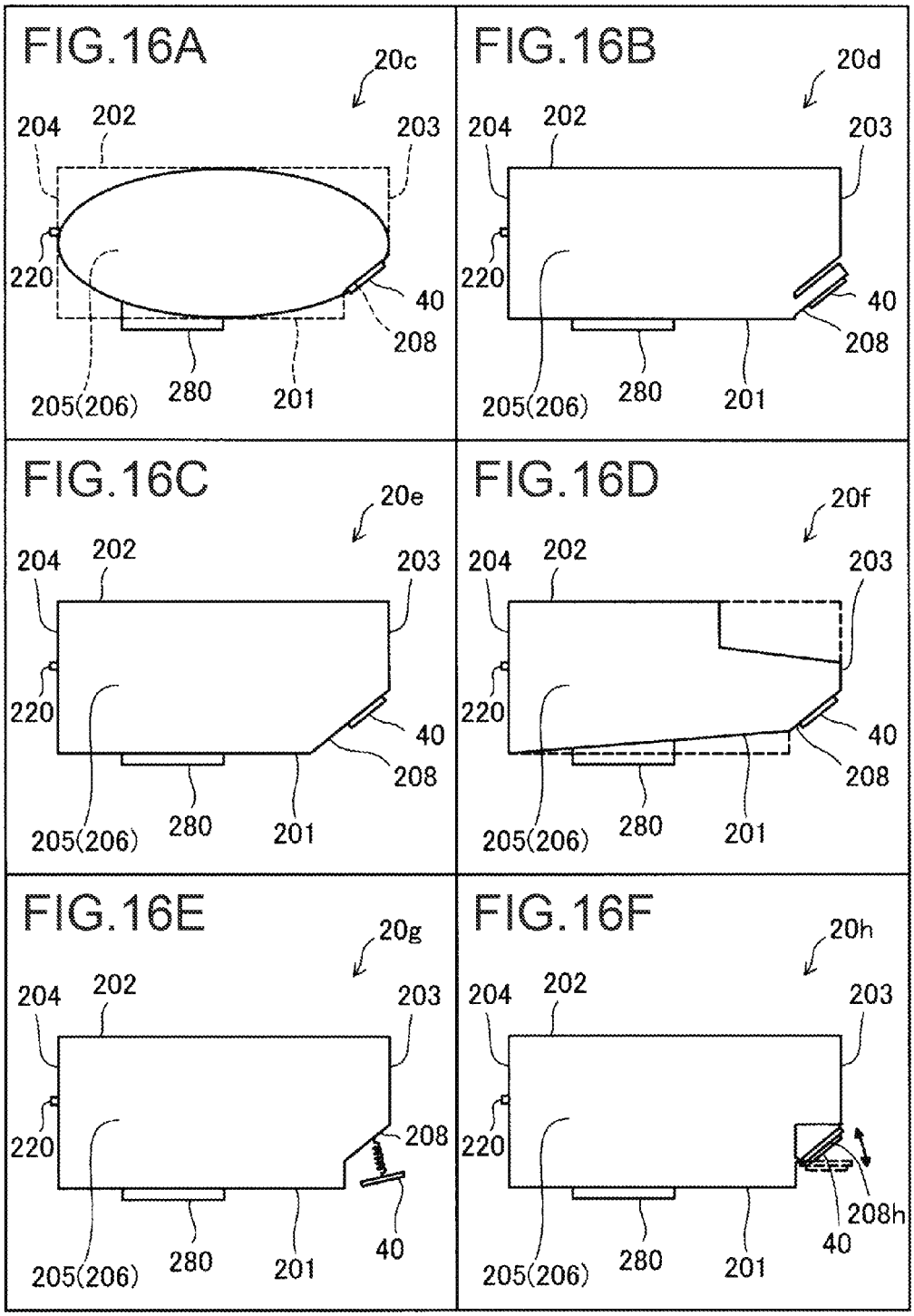
FIGS. 16A to 16F are conceptual diagrams showing modifications of the outer shape of the cartridge.

A cartridge 20*d* shown in FIG. 16B has a substantially rectangular parallelepiped shape as in FIGS. 2 and 15A to 15D. A major difference from the cartridge 20 in FIG. 2 lies in that the eighth face 208 is not provided continuously with the lower end of the third face 203. Cartridges 20*e* and 20*f* shown respectively in FIGS. 16C and 16D are different from the cartridge 20 in FIG. 2 in that the cartridges 20*e* and 20*f* do not have the seventh face. In a cartridge 20*g* shown in FIG. 16E, the circuit board 40 is attached to the eighth face 208 via a spring. In a cartridge 20*h* shown in FIG. 16F, a face 208*h*, which corresponds to the eighth face 208, is movable, and the circuit board 40 is provided on this face 208*h*. In these cartridges 20*c* to 20*g* as well, the circuit board 40 and the ink supply port 280 are configured to be connected to corresponding members of the printer 50, and the cartridges 20*c* to 20*g* can also be compatible with the cartridges 20 and 20*a* in the above-described embodiments.

As can be understood from various examples shown in FIGS. 16A to 16F, various modifications are conceivable for the outer shape of the cartridge. In the case where the outer shape of the cartridge is other than the substantially rectangular parallelepiped shape as well, it is possible to virtually consider, as indicated by dotted lines in FIGS. 16A and 16D, for example, six faces of a substantial rectangular parallelepiped, i.e., the bottom face 201 (first face), the upper face 202 (second face), the front face 203 (third face), the back face 204 (fourth face), the left side face 205 (fifth face), and the right side face 206 (sixth face) shown in FIG. 2. In this specification, the term "face" (plane) can be used as a term to mean both such virtual faces (also called nonexistent faces) and existing faces such as those shown in FIG. 2. Also, the term "face" is used as a term to mean both a flat face and a curved face.

Modifications:

Note that the invention is not limited to the above examples and embodiments, and may be implemented in various modes without departing from the gist of the invention. For example, the following modifications are possible.

Modification 1:

The shapes and structures of each member of the engagement structures 910 and 910*a* to 910*d* in the above-described embodiments are merely examples, and engagement structures having various other shapes and structures are available. In this case as well, it is preferable that the engagement structure of the cartridge has a configuration capable of restricting movement of the cartridge in a direction (+Z direction) extending from the first face 201 toward the second face 202 within the holder 60, and in particular, it is preferable that the first engaging portion 914 projects in the +Y direction from the third face 203. The biasing portions 916 to 918 in the engagement structures 910 and 910*a* to 910*c* may be omitted. However, if the biasing portion is provided, the engagement between the first engaging portion 914 and the holder 60 can be made more reliable.

Modification 2:

In the above-described embodiments and modifications, configurations and members other than the engagement structures 910 and 910*a* to 910*c* can also be altered or omitted as appropriate in accordance with the purpose or use. For example, although the second engaging portion 220 is provided on the fourth face 204 of the cartridge 20 in the above-described embodiments and modifications, the second engaging portion 220 may be provided on the other faces (e.g., the first face 201 or the second face 202). Also, the second engaging portion 220 may be omitted. However, if the second engaging portion 220 is provided, the cartridge 20 can be more reliably engaged with the holder 60 using both the first engaging portion 914 and the second engaging portion 220. Also, in the above-described embodiments and modifications, the circuit board 40 (electric terminal portion) may be omitted.

Modification 3:

The configuration of the cartridges in the above-described embodiments and modifications can be divided into an ink containing chamber member having an ink containing chamber (liquid containing chamber) and an adapter. The ink containing chamber member and the adapter are attached to the holder 60 in a combined state. In this case, it is preferable to provide, in the adapter, at least one of the second engaging portion 220 and the engagement structure 910 (or any of 910*a* to 910*c*) including the first engaging portion 914. In this specification, the configuration divided into the ink containing chamber member and the adapter is also encompassed in the term "ink supply unit" or "liquid supply unit".

Modification 4:

The invention is applicable not only to inkjet printers and ink cartridges thereof, but also to any liquid ejection apparatuses that eject liquid other than ink and liquid supply units attached to holders of these apparatuses. For example, the invention is applicable to various liquid ejection apparatuses and liquid supply units attached to holders of these apparatus as listed below.

(1) Image recording apparatuses such as a facsimile apparatus (2) Color material ejection apparatuses used to manufacture color filters for image display apparatuses such as a liquid crystal display (3) Electrode material ejection apparatuses used to form electrodes for organic EL (Electro Luminescence) displays, field emission displays (FED), and the like (4) Liquid ejection apparatuses that eject liquid containing biological organic matter used to manufacture biochips (5) Sample ejection apparatuses serving as precision pipettes (6) Lubricating oil ejection apparatuses (7) Resin solution ejection apparatuses (8) Liquid ejection apparatuses that perform pinpoint ejection of lubricating oil to precision machines such as a watch and a camera (9) Liquid ejection apparatuses that eject transparent resin solution such as UV-cured resin solution onto substrates in order to form micro-hemisphere lenses (optical lenses) used in optical communication elements and the like

(10) Liquid ejection apparatuses that eject acid or alkaline etchant in order to etch substrates and the like

(11) Liquid ejection apparatuses including liquid ejection heads for discharging a very small amount of any other kinds of droplet Note that the "droplet" refers to a state of the liquid discharged from a liquid ejection apparatus, and includes droplets having a granular shape, a tear-drop shape, and a shape having a thread-like trailing end. Furthermore, the "liquid" mentioned here need only be any kind of material that can be ejected by a liquid ejection apparatus. For example, the "liquid" need only be a material in a state where a substance is in a liquid phase, and a liquid material having a high or low viscosity, sol, gel water, and other liquid materials such as inorganic solvent, organic solvent, solution, liquid resin, and liquid metal (metallic melt) are also included in the "liquid". Furthermore, the "liquid" is not limited to being a one-state substance, and also includes particles of a functional material made from solid matter, such as pigment or metal particles, that are dissolved, dispersed, or mixed in a solvent, and the like. Representative examples of the liquid include ink such as that described in the above embodiments, liquid crystal, and the like. Here, the "ink" encompasses general water-based ink and oil-based ink, as well as various types of liquid compositions such as gel ink and hot melt-ink.

Although the embodiments of the invention have been described above based on some examples, the above-described embodiments of the invention is for facilitating understanding of the invention, and is not intended to limit the invention. Needless to say, the invention can be altered and improved without departing from the gist and the claims of the invention, and the invention encompasses equivalents thereof.

What is claimed is:

1. A liquid supply unit to be attached to an on-carriage holder of a liquid ejection apparatus, the liquid supply unit comprising:

a main body having:

a first face;

a second face opposed to the first face;

a third face intersecting the first face and the second face;

a fourth face intersecting the first face and the second face and opposed to the third face; and a liquid supply portion projecting from the first face in a −Z-direction extending from the second face toward the first face, the liquid supply portion being biased from the on-carriage holder in a +Z-direction extending from the first face toward the second face in a state where the liquid supply unit is attached to the on-carriage holder; and an engagement structure different than the main body and installed to the main body, the engagement structure having:

a first engaging portion projecting from the third face in a +Y-direction extending from the fourth face toward the third face, the first engaging portion adapted to restrict movement of the liquid supply unit from the on-carriage holder in the +Z-direction in a state where the liquid supply unit is attached to the on-carriage holder, the first engaging portion being movable in the +Y-direction and in a −Y-direction opposite the +Y-direction; and an operation portion exposed from the second face in the +Z-direction, the operation portion being linked to the first engaging portion to move the first engaging portion the −Y-direction.

2. The liquid supply unit according to claim 1, further comprising:

an electric terminal portion arranged between the first face and the third face, wherein the operation portion and the first engaging portion are arranged at a position of the electric terminal portion as projected in the +Z-direction.

3. The liquid supply unit according to claim 1, wherein the operation portion is provided on the second face.

4. The liquid supply unit according to claim 1, wherein the first engaging portion is adapted to move in a sliding manner in the +Y-direction.

5. The liquid supply unit according to claim 1, wherein the first engaging portion and the operation portion are integrally molded with each other.

6. The liquid supply unit according to claim 1, further comprising:

a biasing portion that biases the first engaging portion in the +Y-direction.

7. The liquid supply unit according to claim 6, further comprising:

an electric terminal portion arranged between the first face and the third face, wherein the biasing portion is located at a position between the liquid supply portion and the electric terminal portion in the −Y-direction.

8. A liquid supply unit according to claim 6, wherein the biasing portion is integrally molded with the first engaging portion and the operation portion.

9. The liquid supply unit according to claim 1, further comprising:

a second engaging portion projecting from the fourth face in the +Y-direction, the second engaging portion adapted to restrict movement of the liquid supply unit from the on-carriage holder in the +Z-direction in a state where the liquid supply unit is attached to the on-carriage holder.

10. A liquid supply unit according to claim 9, wherein the first engaging portion is integrally molded with the second engaging portion, the operation portion, and the biasing portion.

* * * * *